US007274901B2

(12) United States Patent
Winter et al.

(10) Patent No.: US 7,274,901 B2
(45) Date of Patent: Sep. 25, 2007

(54) METHOD AND ARRANGEMENT FOR GENERATING POSITIONALLY ACCURATE PRINT IMAGES ON A CARRIER MATERIAL

(75) Inventors: Hans Winter, München (DE); Johann Bartosch, Taufkirchen (DE); Holger Hofmann, Wörth (DE); Heinrich Lay, Töging am Inn (DE); Günther Gassner, Mühldorf (DE); Frank Freudenberg, Markt Schwaben (DE)

(73) Assignee: Oce Printing Systems GmbH, Poing (DE)

( * ) Notice: Subject to any disclaimer, the term of this patent is extended or adjusted under 35 U.S.C. 154(b) by 218 days.

(21) Appl. No.: 10/924,030

(22) Filed: Aug. 23, 2004

(65) Prior Publication Data

US 2005/0089350 A1 Apr. 28, 2005

(30) Foreign Application Priority Data

Aug. 21, 2003 (DE) ..... 103 38 496
Aug. 21, 2003 (DE) ..... 103 38 497

(51) Int. Cl.
*G03G 15/01* (2006.01)

(52) U.S. Cl. ..... 399/301; 399/394; 399/396

(58) Field of Classification Search ..... 399/301, 399/394, 396, 16, 384, 231
See application file for complete search history.

(56) References Cited

U.S. PATENT DOCUMENTS 4,416,534 A * 11/1983 Kluger ..... 399/396
4,475,805 A 10/1984 Omi
4,943,863 A * 7/1990 Ainoya ..... 399/384
5,442,428 A 8/1995 Takahashi et al.
5,761,594 A 6/1998 Seto et al.
5,848,345 A * 12/1998 Stemmle ..... 399/384
6,505,015 B1 1/2003 Winter et al.
6,606,475 B1 8/2003 Maier et al.
6,633,737 B1 * 10/2003 Tanaka et al. ..... 399/301

FOREIGN PATENT DOCUMENTS

DE 44 17 807 A1 12/1994
DE 19542 612 A1 5/1996
WO WO 00/34831 6/2000
WO WO 00/54266 9/2000
WO WO 00/54266 A3 9/2000

* cited by examiner

*Primary Examiner*—David M. Gray
*Assistant Examiner*—Laura K Roth
(74) *Attorney, Agent, or Firm*—Schiff Hardin LLP

(57) ABSTRACT

The invention relates to a method and an arrangement for generating positionally-accurate print images on a carrier material with the aid of an electrophotographic printer or copier. A positioning error of the position of the carrier material with respect to a toner image present on the toner image carrier is determined, which error occurs during the contacting of a carrier material to be printed. Dependent on the positioning error determined, for every subsequent contacting of the carrier material to be printed with the toner image carrier, the position of the carrier material with respect to the toner image is adapted before the contacting such that the carrier material and the toner image are arranged with respect to one another substantially free of positioning errors.

38 Claims, 17 Drawing Sheets

T10=T12=T1+T11=T13-T5

METHOD AND ARRANGEMENT FOR GENERATING POSITIONALLY ACCURATE PRINT IMAGES ON A CARRIER MATERIAL

BACKGROUND OF THE INVENTION

When print images are generated on a carrier material with the aid of an electrophotographic printer or copier, positioning errors of a toner image generated on a toner image carrier with respect to a carrier material to be printed with the toner image occur particularly due to the structure and the sequence of the printing process in the printer or copier.

Register errors result from these positioning errors, especially when the carrier material is printed on several times and when multicolor documents are generated, and then the generated print images are not superimposed in a register-accurate manner. When the toner image carrier, for example, a transfer belt, is brought into contact with a carrier material to be printed, positional displacements of the print image in the range of ≦2 mm occur in known high-performance printers, which positional displacements cannot be reduced further by way of a mechanical adjustment at an acceptable expense.

Particularly in the case of multicolor printing, these print image displacements are, however, visible when several color separations successively applied to the carrier material are not positioned exactly on top of one another. And likewise, printing a print image on a carrier material and arranging a second print image exactly next to the first print image after an interruption of the printing process is difficult due to the possible positioning errors described since, in particular, the overlapping of the print images is disturbing and has to be avoided.

International patent application WO 00/54266 discloses a device for transferring at least one toner image from a toner image carrier belt onto a carrier material. In this process, the toner image carrier belt is guided such that in the case of a swivel motion of a roll device, the belt tension always remains the same. For transfer printing the toner image present on the toner image carrier belt onto the carrier material, the surface of the toner image carrier belt with the toner image present thereon is brought into contact with the surface of the carrier material via the swivel motion of the roll device, i.e., the carrier material is contacted by the toner image carrier belt.

International patent application WO 00/34831 discloses an electrophotographic printing device comprising a photoconductor and a transfer belt, a toner image to be transferred onto a carrier material being generated on the photoconductor and being transferred onto the transfer belt. Subsequently, the toner image transferred onto the transfer belt is transfer-printed onto a carrier material. In addition to the print image to be generated on the carrier material, a position mark is generated from toner material on the photoconductor, which mark is likewise transfer-printed onto the transfer belt and is detected via a sensor. The running time of the toner mark from its generation on the photoconductor up to the time of detection at the sensor is determined, and the transport of the carrier material is controlled dependent on the running time determined.

U.S. Pat. No. 4,475,805, International Patent publication no. WO 2000/34 831 A1, and German Patent document nos. DE 44 17 807 A1 and DE 195 42 612 A1 disclose further electrophotographic image generating devices.

The positional errors occurring during the contacting of the carrier material with the transfer belt at the start of the printing process for generating a new print image on the carrier material can, at present, not be prevented with the known methods for high-performance printers or copiers. The known devices serve to guarantee an exact positioning during a continuous printing process. A method or an arrangement for the effective prevention of positioning errors occurring during a start of the printing process, particularly due to the contacting of the transfer belt with the carrier material, is, at present, not known in the prior art. In particular, when a print image is joined flush with a print image that has already been printed on the carrier material in a preceding printing process and when several color separations are printed on top of one another, these positioning errors are visible in the generated print image.

SUMMARY OF THE INVENTION

The object of the invention is to provide a method and an arrangement in which positioning errors of the print images on the carrier material are avoided and register-accurate print images are generated.

This object is achieved by a method for generating positionally accurate print images on a carrier material with the aid of an electrophotographic printer or copier, comprising: contacting a carrier material to be printed with a toner image carrier, a positioning error occurring; determining the positioning error of a position of the carrier material with respect to a toner image present on the toner image carrier; and adapting, dependent on the positioning error determined, for every subsequent contacting of the carrier material to be printed with the toner image carrier, the position of the carrier material with respect to the toner image before contacting such that the carrier material and the toner image are arranged with respect to one another substantially free of positioning errors.

This object is also achieved by a method for generating positionally accurate print images on a carrier material with the aid of an electrophotographic printer or copier, comprising: generating at least a first toner image on a toner image carrier; transfer-printing the first toner image from the toner image carrier onto a carrier material, the carrier material being contacted by the toner image carrier during the transfer printing at at least one transfer printing point; performing a relative movement, after the transfer printing of the first toner image, between the carrier material and the toner image carrier such that the carrier material is no longer contacted by the toner image carrier; generating at least a second toner image on the toner image carrier, positioning the carrier material, for the transfer printing of the second toner image, with respect to the position of the second toner image generated on the toner image carrier such that the second toner image is transfer-printed at a predetermined distance to the first toner image; and correcting, depending on a printer-specifically or copier-specifically determined positioning error occurring during the positioning of the carrier material, at least one of a position of the carrier material and a position of the toner image carrier.

This object is also achieved by a method for generating positionally accurate print images on a carrier material aided by an electrophotographic printer or copier, comprising: generating at least one toner image on a toner image carrier, at least one portion of the toner image being generated during a first operating state, in which a surface of the toner image carrier does not contact a carrier material to be printed; driving the toner image carrier at a first circulation speed during the first operating state; driving the carrier material at a transport speed during transfer printing of the toner image from the toner image carrier onto the carrier material, the transport speed being at least slightly slower than the first circulation speed; moving the toner image carrier and the carrier material relative to one another such that the surface of the toner image carrier contacts the carrier material to be printed for the transfer printing of the toner image during a second operating state; reducing the first circulation speed of the toner image carrier to a second circulation speed after contacting; and determining and correcting a positioning error caused by the change in circulation speed during the transfer printing of the toner image at a transfer printing point.

This object is further achieved by an arrangement for generating positionally accurate print images on a carrier material aided by an electrophotographic printer or copier, comprising: carrier material to be printed; and a toner image carrier that contacts the carrier material, wherein a positioning error occurs, wherein, dependent on the determined positioning error occurring during the contacting of the carrier material to be printed with the toner image carrier, for every contacting of the carrier material to be printed with the toner image carrier, the carrier material and the toner image are positioned with respect to one another before the contacting such that after the contacting, the carrier material is positioned with respect to the toner image substantially free of positioning errors.

This object is also achieved by an arrangement for generating positionally accurate print images on a carrier material aided by an electrophotographic printer or copier, comprising: a toner image carrier on which at least one toner image can be generated, at least a portion of the toner image being generatable in a first operating state, in which the surface of the toner image carrier does not contact a carrier material to be printed; a first drive unit configured to drive the toner image carrier at a first circulation speed during the first operating state; a second drive unit configured to drive the carrier material at a transport speed during the transfer printing of the toner image from the toner image carrier onto the carrier material, the transport speed being at least slightly slower than the first circulation speed; a device configured to perform a relative movement between the toner image carrier and the carrier material such that a surface of the toner image carrier contacts the carrier material to be printed for transfer printing the toner image in a second operating state, and after contacting, the first circulation speed of the toner image carrier being reduced to a second circulation speed, which approximately corresponds to the transport speed of the carrier material, the positioning error caused by the change in circulation speed during the transfer printing of the toner image at the transfer printing point being determinable and at least one of the first and second drive unit being controllable such that the carrier material is arranged with respect to the toner image substantially free of positioning errors during transfer printing.

Finally, this object is achieved by an arrangement for generating positionally accurate print images on a carrier material aided by an electrophotographic printer or copier, comprising: a toner image carrier on which at least a first toner image and at least a second toner image can be generated; a device configured for performing a relative movement between the toner image carrier and a carrier material; a control unit configured for controlling the relative movement such that the toner image carrier contacts the carrier material during transfer printing of each toner image from the toner image carrier onto the carrier material at at least one transfer printing point, and in that the carrier material no longer contacts the toner image carrier after the transfer printing of the first toner image; a drive unit configured for conveying the carrier material, which, for transfer printing the second toner image onto the carrier material, positions the carrier material such that the second toner image is transfer-printed onto the carrier material at a preset distance to the first toner image; the arrangement being configured to, dependent on a printer-specific or copier-specific positioning error occurring during the positioning of the carrier material, perform a correction of at least one of the position of the carrier material and the position of the toner image carrier.

In various embodiments of the inventive method, a positioning error in the position of the carrier material with respect to a toner image present on the toner image carrier occurring when a carrier material to be printed is brought into contact with a toner image carrier is determined. Dependent on the positional error determined, every subsequent time the carrier material to be printed is brought into contact with the toner image carrier, the position of the carrier material with respect to the print image is adapted before the contacting such that the carrier material is positioned with respect to the print image substantially free of positioning errors.

Positioning errors of the print image on the carrier material occurring at the start of a new printing process, particularly when contacting the toner image carrier with the carrier material, are likewise avoided. Thus, the print images can be correctly positioned on the carrier material at any time, as a result of which register-accurate print images and documents can be produced.

A second aspect of various embodiments of the invention relates to a further method for generating register-accurate print images. In this method, at least a first toner image is generated on a toner image carrier. The first toner image is transfer-printed from the toner image carrier onto a preferably continuous carrier material, the carrier material being contacted by the toner image carrier during transfer-printing at at least one transfer printing point. After transfer printing of the first toner image, a relative movement between the carrier material and the toner image carrier is performed such that the carrier material is no longer contacted by the toner image carrier.

At least a second toner image is generated on the toner image carrier. For transfer printing the second toner image, the carrier material is positioned with respect to the position of the second toner image generated on the toner image carrier such that the second toner image is transfer-printed at a predetermined distance to the first toner image. Dependent on a printer-specifically or copier-specifically determined positioning error occurring during the positioning of the carrier material, the position of the carrier material and/or the position of the toner image carrier is corrected.

This achieves successively generated print images that are arranged in a correct position with respect to one another, and subsequently, the print images of several print pages lie on top of one another with register accuracy in a document comprising successive print pages and generated with the aid of the print images.

A third aspect of various embodiments of the invention relates to an arrangement for generating register-accurate print images on a carrier material with the aid of an electrophotographic printer or copier. Dependent on a determined positioning error occurring when contacting a carrier material to be printed with a toner image carrier, the carrier material and the toner image are, every time the carrier material to be printed is brought into contact with the toner image carrier, positioned relative to one another before the contacting such that after the contacting the carrier material is arranged relative to the toner image substantially free of positioning errors. What is achieved with this arrangement is that the print images are generated on the carrier material free of positioning errors and with register accuracy.

A fourth aspect of various embodiments of the invention relates to a further arrangement for generating register-accurate print images on the carrier material with the aid of an electrophotographic printer or copier. The arrangement includes a toner image carrier, on which at least a first toner image and at least a second toner image can be generated. Further, the arrangement includes a device for performing a relative movement between the toner image carrier and a continuous carrier material, a control unit controlling the relative movement such that the toner image carrier contacts the carrier material during the transfer printing of each toner image from the toner image carrier onto the carrier material at at least one transfer printing point and in that, after the transfer printing of the first toner image, the carrier material no longer contacts the toner image carrier.

Further, the arrangement includes a drive unit for conveying the carrier material, which drive unit positions the carrier material for the transfer printing of the second toner image such that the second toner image is transfer-printed onto the carrier material at a predetermined distance to the first toner image. Dependent on a printer-specifically or copier-specifically determined positioning error occurring during the positioning of the carrier material, the arrangement controls a correction of the position of the carrier material and/or of the position of the toner image carrier.

What is achieved is that, even in the start-stop-operation or after the start of a new printing process, the print images are generated on the carrier material free of positioning errors, as a result of which register-accurate documents can be generated. Even when at least two toner images having different toner colors are successively generated on the toner image carrier, with the toner images being generated on the toner image carrier on top of one another, these toner images, also referred to as color separations, lie on top of one another with register accuracy via the arrangement. This arrangement permits all color separations to be generated with the same size. A compression, i.e., a down-scaling in the transport direction, of individual color separations or of an area of a color separation is avoided.

A fifth aspect of various embodiments of the invention relates to a further method for generating register-accurate print images on a carrier material with the aid of an electrophotographic printer or copier. At least one toner image is generated on a toner image carrier, at least a portion of the toner image being generated during a first operating state in which the surface of the toner image carrier does not contact a carrier material to be printed. The toner image carrier is driven at a first circulation speed during the first operating state. During the transfer printing of the toner image from the toner image carrier onto the carrier material, the carrier material is driven at a transport speed, this transport speed being at least slightly slower than the first circulation speed.

The toner image carrier and the carrier material are moved relative to one another such that the surface of the toner image carrier contacts the carrier material to be printed for transfer printing the toner image during a second operating state. The first circulation speed of the toner image carrier is reduced to a second circulation speed after contacting. The positioning error caused by the change in circulation speed during the transfer printing of the toner image at the transfer printing point is determined and corrected.

This achieves correctly positioned print images being generated, which lie on top of one another with register accuracy. This is even guaranteed when at least, particularly during the start-stop-operation of the printer or copier, no continuous operation of the printer or copier during printing on a continuous carrier material is possible and the front edge of a new print image is to be positioned at the rear edge of a print image already printed on the carrier material after the start of a new printing process. Even when generating at least two toner images having different toner colors and/or different toner types successively and on top of one another on the toner image carrier, these toner images are generated on top of one another with register accuracy so that in no area of the print image a misalignment between the individual color separations occurs. Thus, multi-color prints of high-quality are generated.

When printing the two toner images having different toner colors, i.e., the two color separations, on top of one another, a multi-color toner image is generated.

DESCRIPTION OF THE DRAWINGS

For the purposes of promoting an understanding of the present invention, reference will now be made to the preferred embodiments illustrated in the drawings and specific language will be used to describe the same. It will nevertheless be understood that no limitation of the scope of the invention is thereby intended, such alterations and further modifications in the illustrated devices and/or method, and such further applications of the invention as illustrated therein being contemplated as would normally occur now or in the future to one skilled in the art to which the invention relates. Embodiments of the invention are shown in the figures.

DETAILED DESCRIPTION OF THE PREFERRED EMBODIMENTS

Figure 1:
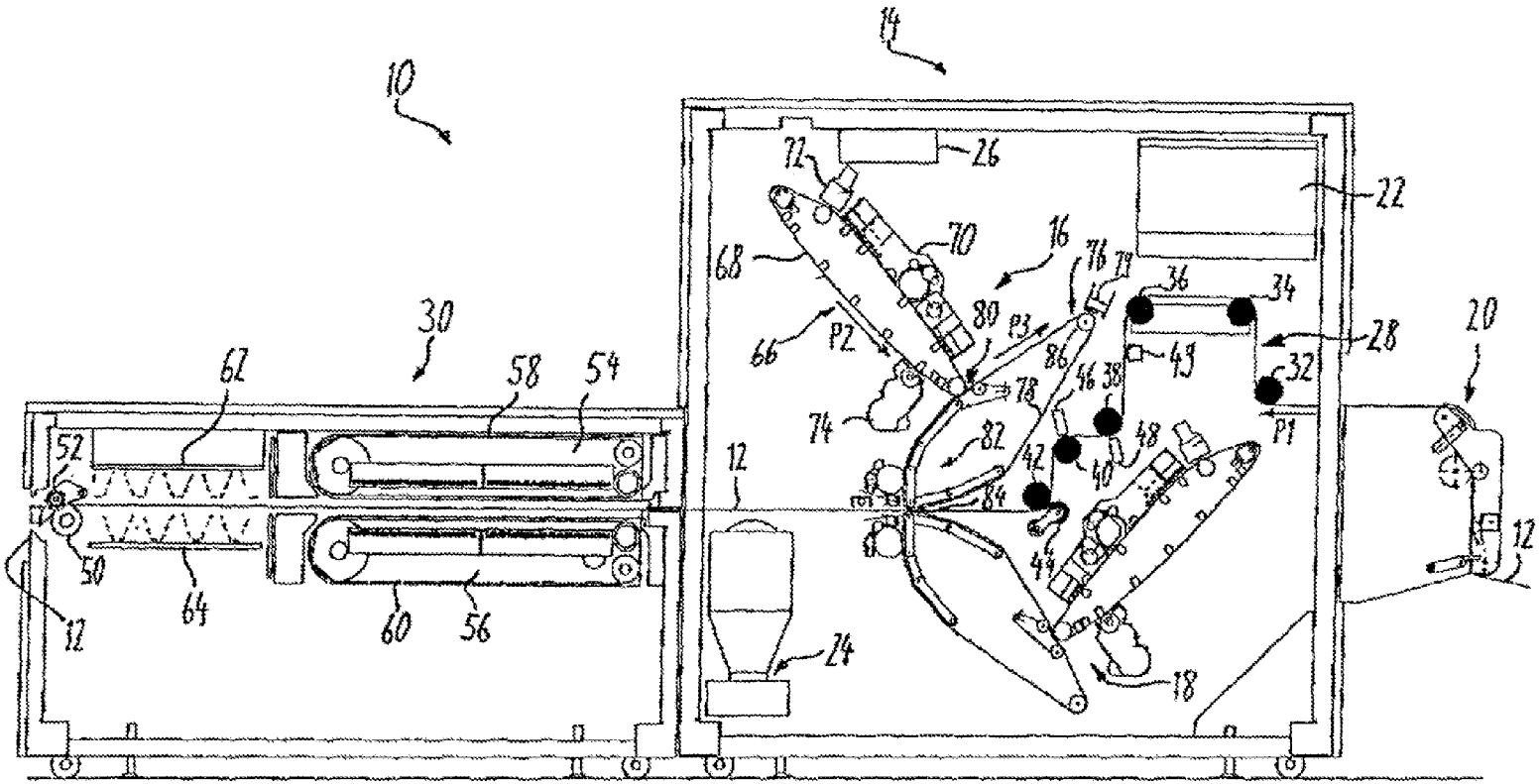
FIG. 1 is a pictorial schematic showing the structure of a printer having two printing units.

FIG. 1 illustrates an electrophotographic high-performance printing system 10 for printing on a continuous paper web 12 according to an embodiment of the invention. A printing mechanism 14 includes a first image generating and transfer printing unit 16 for printing on the front side of the paper web 12 as well as a second image generating and transfer printing unit 18 for printing on the rear side of the paper web 12. The image generating and transfer printing units 16, 18 are referred to as printing units 16, 18 in the following. The printing unit 16 has substantially the same structure as the printing unit 18. The printing mechanism 14 further includes a paper feeding device 20, a control unit 22, a toner storage and preparation system 24, an image data processing unit 26 as well as a paper web guiding and monitoring system 28.

The paper web 12 is conveyed with the aid of the paper web guiding and monitoring system 28 in the direction of the arrow P1 through the printing system 10, the paper web 12, after having been printed in the printing mechanism 14, being supplied to a fixing station 30 in which the toner images generated by the printing mechanism 14 on the paper web 12 are fixed. The paper web guiding and monitoring system 28 includes deflection rollers 32 to 40 as well as a drive roller 42 with an opposite pressure roller 44.

Further, two mark sensors 46, 48 are provided, which monitor the position of synchronization marks applied to the paper web 12. Further still, a marginal perforation sensor 49 is provided that detects the position of the marginal perforations provided in the paper web 12. The position of the marginal perforations and/or synchronization marks are brought to a desired position with the aid of a closed-loop control system via a corresponding control of the drive motor of the paper 12 and/or are kept in this desired position. In the fixing station 30, a further drive roller 50 with an opposite pressure roller 52 is provided for the paper take-off.

The fixing station 30 includes a first fixing unit 54 and a second fixing unit 56, which are provided on the opposite sides of the paper web 12, the first fixing unit 54 fixing the toner images on the front side and the second fixing unit 56 fixing the toner images on the rear side of the paper web 12. The fixing units 54, 56 are implemented as radiation fixing units, the fixing units 54, 56 each including a covering unit 58, 60 which blocks the radiation of the fixing units 54, 56 during operating states in which no fixing of the toner images on the paper web 12 is to take place. As viewed in the transport direction of the paper web 12, cooling elements 62, 64 are provided downstream of the fixing units 54, 56, which cool down the paper web 12 before it exits the fixing station 30 in order to avoid damage of the paper web 12, particularly as a result of too little paper moisture.

The first printing unit 16 and the second printing unit 18 are provided on sides of the paper web 12 facing away from one another. The paper web 12 can be conveyed both in the direction of the arrow P1 as well as in the opposite direction with the aid of the drive roller 42, in the following a forward movement referring to the transport of the paper web 12 in the direction of the arrow P1 and a backward movement referring to the transport of the paper web 12 in the opposite direction to the direction of the arrow P1. The function of the printing mechanism 14 and of the fixing station 30 is described in detail in the International Patent Publication no. WO 00/34831 and in the German patent document DE 198 27 210 C1, which are herewith incorporated by reference into the present application.

The first printing unit 16 includes a first belt drive 66 with a photoconductor belt 68, commonly also referred to as an "OPC belt". The photoconductor belt 68 is driven with the aid of the belt drive 66 in the direction of the arrow P2. With the aid of a cleaning and charging unit 70, the photoconductor belt 68 is discharged, toner rests are removed from the photoconductor belt 68, and it is charged to a predetermined potential.

Using a character generator 72, which is implemented as an LED character generator, areas of the uniformly charged surface of the photoconductor belt 68 are, depending on the electrophotographic principle used, discharged to a lower potential or charged to a higher potential partially, i.e., pixel-wise, in accordance to the signals supplied to the character generator 72 by the image data processing unit 26, as a result of which a charge image is generated on the surface of the photoconductor belt 68. The charge image present on the surface of the photoconductor belt 68 includes a latent print image. With the aid of a developer unit 74, the charge image on the surface of the photoconductor belt 68 is inked with toner so that a toner image is generated.

The printing unit 16 further includes a second belt drive 76 comprising a transfer belt 78, which is driven in the direction of the arrow P3. The photoconductor belt 68 contacts the transfer belt 78 at a transfer printing point 80, i.e., the surface of the photoconductor belt 68 contacts the surface of the transfer belt 78, as a result of which a toner image present on the photoconductor belt 68 is transferred onto the surface of the transfer belt 78. With the aid of a roll device 82, the rolls of which are connected to one another via levers, the transfer belt 78 is guided in a transfer printing area 84 onto the paper web 12 as well as guided away from the same, the transfer belt 78 being illustrated in FIG. 1 in a position in which it is brought into contact with the paper web 12.

In this state, the transfer belt 78 contacts the surface of the paper web 12 on its front side, as a result of which a toner image present on the transfer belt 78 is transferred from the transfer belt 78 onto the front side of the paper web 12. Bringing the transfer belt 78 into contact with the paper web 12 is also referred to as "swiveling-onto" and the leading away of the transfer belt 78 from the paper web 12 is also referred to as "swiveling-away".

As previously mentioned, the printing unit 18 has the same substantial structure as the printing unit 16, a charge-reversal unit 79 for reversing the charge of the toner image present on the transfer belt 78 being provided at the belt drive 76 of the printing unit 16. The transfer belts of the printing unit 16 and of the printing unit 18 are substantially simultaneously swiveled onto the paper web 12, as a result of which a contact pressure is generated between two opposite rolls of the belt drives of the transfer belts.

The toner image on the transfer belt 78 is charge-reversed with the aid of a charge-reversal unit 79 that is implemented as a corotron arrangement. By way of the charge-reversal of the toner image on the transfer belt 78, the toner particles of the toner images on the front and on the rear side have different charges so that the transfer of the toner images onto the paper web 12 in the transfer printing area 84 is made possible by the forces of attraction between the oppositely charged toner particles acting through the paper web 12.

A roll device 82 for bringing the transfer belt 78 into contact with the paper web 12 or leading the same away from the paper web is described in detail in the International Patent Publication no. WO 00/54266, the content of which is herewith incorporated in the present application. The transfer belt 78 of the belt drive 76 is driven by the drive roll 86. The character generator 72 generates a charge image on the charged photoconductor belt 68. The developer station 74 inks the photoconductor belt 68 with toner material in accordance with the charge image and thus generates a toner image corresponding to the charge image. At the first transfer printing point 80, the toner image is transfer-printed from the photoconductor belt 68 onto the transfer belt 78. At the second transfer printing point 84, the toner image is transfer-printed from the transfer belt 78 onto the paper web 12.

Subsequently, the toner image is supplied with the paper web 12 to the fixing station 30, in which the toner image is fixed and thus firmly joined to the paper web 12. The drive speed of the transfer belt 78 is pre-set slightly higher than the transport speed of the paper web 12. The difference in speed preferably lies in the range of 0.1% to 10%, preferably 0.5 to 3%. The difference in speed serves to keep the relatively flexible paper web 12 tensioned at the transfer printing point 84 and thus to avoid difficulties in the running of the paper, such as a fluttering of the paper. When the transfer belt 78 is swiveled onto the paper web 12, as described, a pulling force of the transfer belt 78 acts on the paper web 12 as a result of the high speed and causes a pulling force in the transport direction P1 of the paper.

Figure 15:
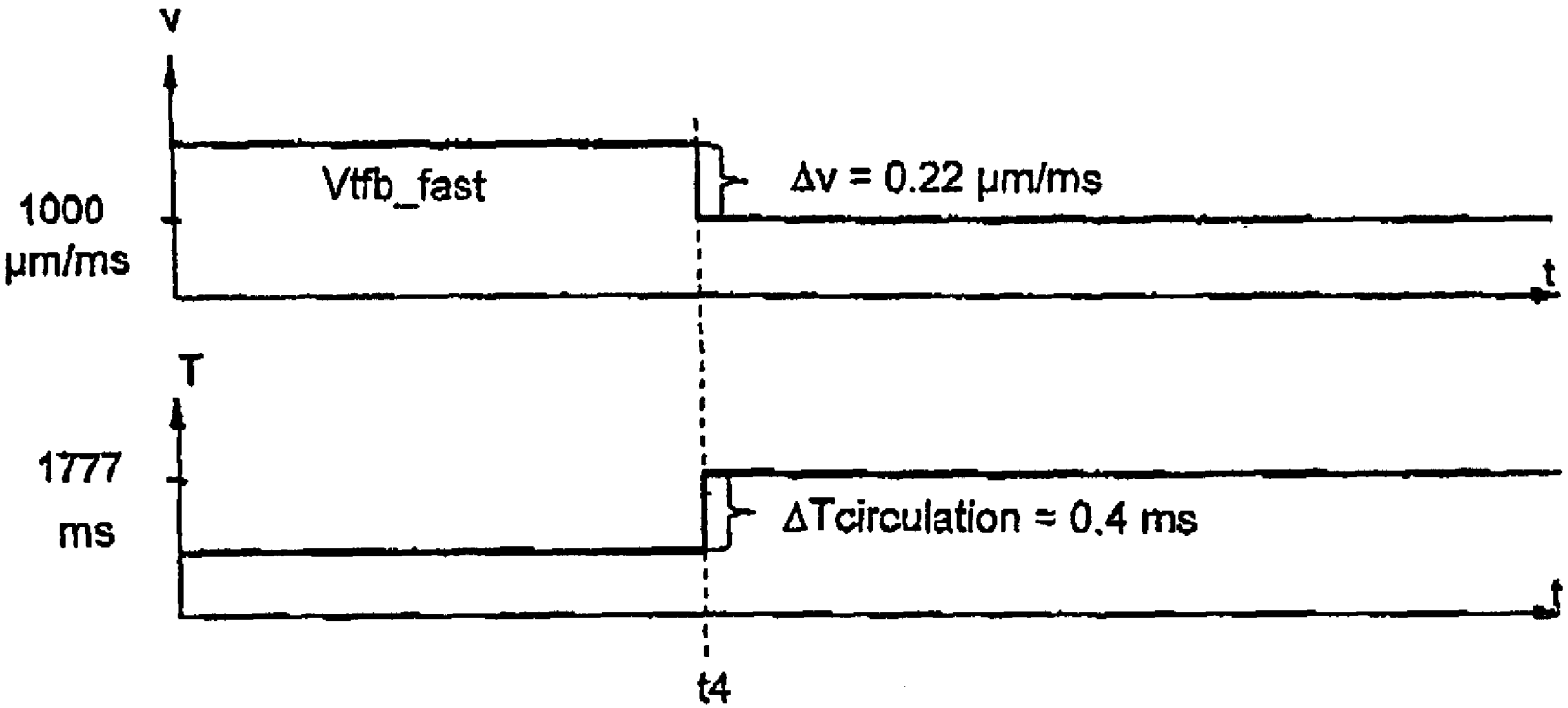
FIG. 15 is a speed-time diagram as well as a circulation time-time diagram illustrating the change in circulation speed as well as in circulation time when the transfer belt is swiveled onto the paper web.

For example, the circulation speed of the transfer belt 78 in the state in which it is not swiveled onto the paper web 12 is about 2% higher than the transport speed of the paper web 12. When the transfer belt 78 is swiveled onto the paper web 12, the transfer belt 78 is decelerated, as a result of which the circulation speed is reduced by 0.22%, as illustrated in FIG. 15. Therefore, after the transfer belt 78 has been swiveled onto the paper web 12, i.e., in the swiveled-onto state of the transfer belt 78, its circulation speed is still about 1.8% higher than the transport speed of the paper web 12.

The load on the drive motor of the drive roller 42, preferably a stepper motor, is relieved by the pulling force acting on the paper web 12, as a result of which a change in the load angle at the drive motor takes place. The change in the load angle causes a change in position of the paper web 12 in the transport direction in the range of 0.01 mm to 1 mm, usually in the range of 0.2 mm to 0.9 mm. After the transfer belt 78 has been swiveled away from the paper web 12, again an enlargement of the load angle and a positional displacement of the paper web 12 take place opposite to the change in position previously caused when the transfer belt 78 had been swiveled onto the paper web.

Figure 2:
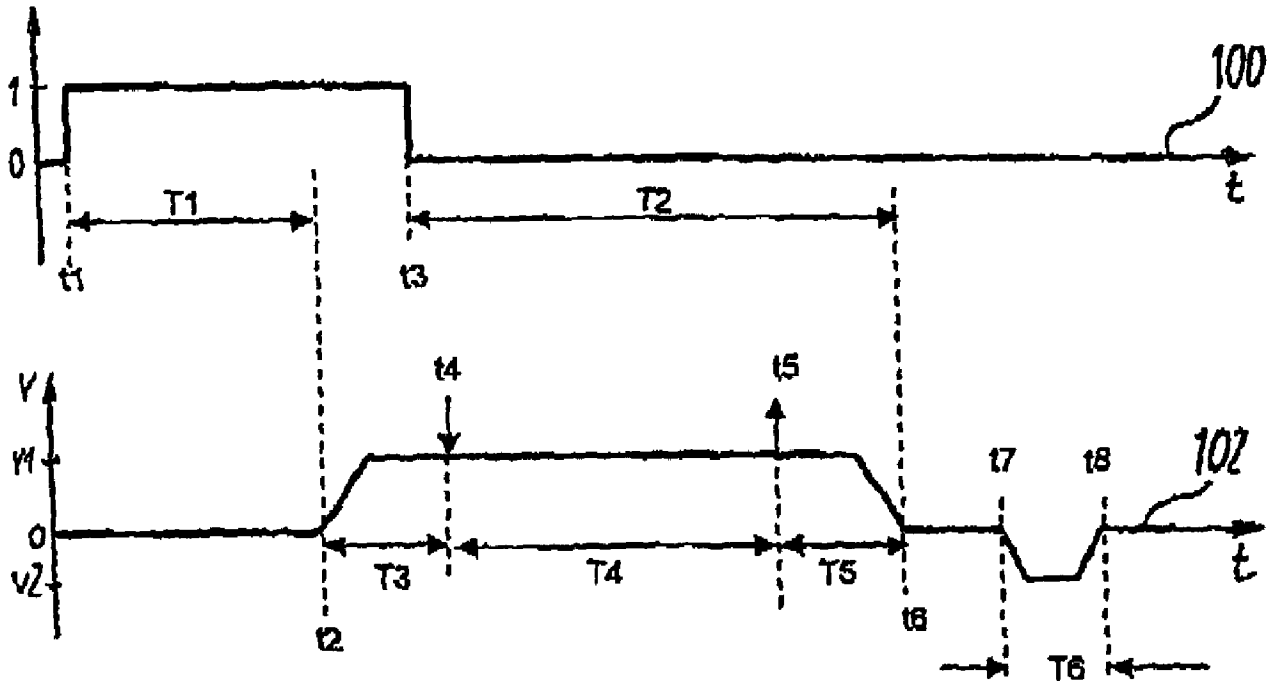
FIG. 2 is a speed-time diagram illustrating the speed curve of the paper transport as a function of the activation of the image generating unit.

FIG. 2 is a timing diagram illustrating the transport speed of the paper web 12 as a function of an image generating signal as plotted on a time axis t. The graph 100 illustrates the image generating control signal, and the graph 102 illustrates the speed curve of the transport speed of the paper web 12. At the time t1, the character generator 72 starts the generation of a charge image in accordance with the print data processed in the image data processing unit 26, after the image generating signal has been changed from the state 0 to the state 1. After a start delay time T1, the motors of the drive rollers 42 and 52 are activated and the paper web 12 is accelerated to the transport speed v1. After the generation of the charge image by the character generator 72 on the photoconductor belt 68, the charge image, as already described in connection with FIG. 1, is inked with toner and the generated toner image is transferred onto the transfer belt 78 and further conveyed to the transfer printing point 84.

At the time t4, the toner image corresponding to the charge image generated at the time t1, arrives at the transfer printing point 84 and, from the time t4 on, is transferred onto the paper web 12. In the present embodiment, a print page having a length of 12 inch is to be generated on the paper web 12. The generation of a corresponding charge image is completed at the time t3. The transfer of the toner image generated on this charge image onto the paper web 12 is completed at the time t5. At the time t3, thus the generation of charge images by the character generator 72 is stopped, the image generating signal having been changed from 1 to 0.

At the time t4, the transfer belt 78 is swiveled onto the paper web 12, remains in contact with the paper web 12 during the time interval T4, i.e., up to the time t5, and is again swiveled away from the paper web 12 at the time t5.

The transfer belt 78 thus only contacts the paper web 12 in the time interval T4. In the time interval T5, the transport of the paper web 12 is stopped by the drive motors of the drive rollers 42 and 52 in a defined way so that at the time t6 again a transport speed of 0 is reached and thus the paper web 12 stands still. Thus, an interval of T2 results of a stop deceleration after the termination of the generation of a charge image at the time t3 up to the standstill of the paper web 12.

Subsequently, at the time t7, the paper web 12 is accelerated to a speed v2, the drive being effected in the opposite direction to the arrow P1 and the paper web 12 thus being conveyed backward or being pulled backward. The backward transport of the paper web 12 takes place for the time interval T6, i.e., up to the time t8. In the time interval T6, the paper web 12 is conveyed backward so that in the case of a new printing process, the new printed pages are printed such that they join flush with the pages printed in the preceding printing process.

Figure 3:
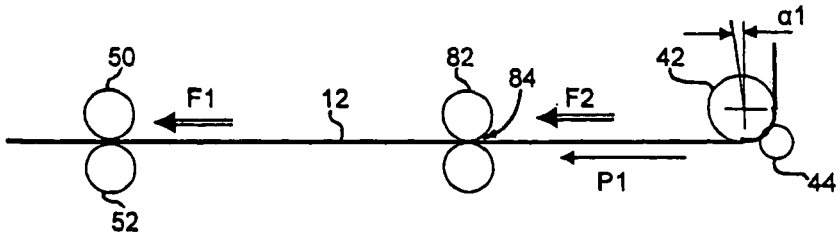
FIG. 3 is a schematic illustration of the paper drive when the transfer belts are swiveled onto the paper web.

In FIG. 3, the transport of the paper web 12 through the printing system 10 according to FIG. 1 is illustrated in a simplified manner. In the operating state illustrated in FIG. 3, the transfer belts are swiveled onto the paper web 12. For tensioning the paper web 12 in the transfer printing area and in the fixing station, the drive roller 52 exerts a force F1 onto the paper web 12. By the application of the roll arrangement 82 of the transfer belt drives 76 in the transfer printing area 84, a pulling force F2 acts on the paper web 12 in the area between the transfer printing area 84 and the drive roller 42. The load angle occurring at the drive motor (not illustrated) of the drive roller 42 is referenced by $\alpha 1$ in the illustration of FIG. 3. Due to the pulling force F2, the load angle $\alpha 1$ is relatively small when the transfer belts 78 are in their swiveled-onto position, i.e., the drive motor has to exert a relatively small force in order to transport the paper web 12 in the direction of the arrow P1.

Figure 4:
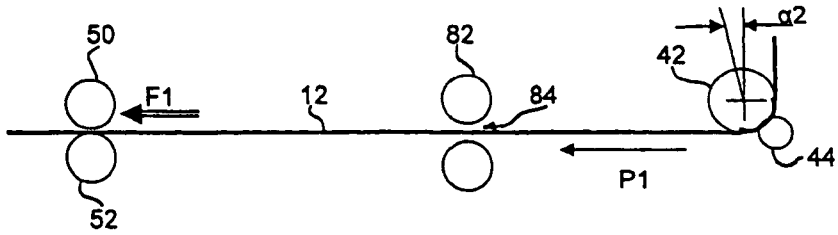
FIG. 4 is the schematic illustration of the paper drive according to FIG. 3 when the transfer belts are swiveled away from the paper.

In FIG. 4, the same simplified illustration of the arrangement according to FIG. 3 is shown, however, in the arrangement according to FIG. 4, the transfer belts do not contact the paper web 12 in the transfer printing area 84. Since the transfer belts are swiveled away, a drive force is no longer introduced into the paper web 12 via these transfer belts, as a result of which the drive motor of the drive roller 42 has to apply a greater drive force. The load angle $\alpha 2$ of the drive motor is thus abruptly enlarged when the transfer belts are swiveled away. When the transfer belts are swiveled onto the paper web, as illustrated in FIG. 3, the smaller load angle $\alpha 1$ only occurs with a certain delay as an equilibrium state and changes relatively continuously from the larger load angle $\alpha 2$, illustrated in FIG. 4, to the smaller load angle $\alpha 1$, illustrated in FIG. 3. The change in the load angle $\alpha$ causes a change in the position of the drive shaft of the drive motor, as a result of which, a change in position, i.e., in the position of the paper web 12, in the range of 0.05 mm to 1 mm, depending on the structure of the printer, also takes place via the drive roller 42.

Figure 5:
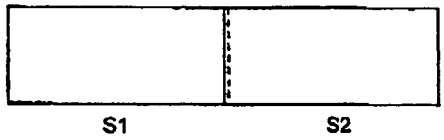
FIG. 5 is a pictorial illustration showing the position of two print pages printed on a continuous paper web with an interruption of the printing operation, the positioning error which occurs in the prior art being illustrated.

FIG. 5 is a schematic illustration of the arrangement of two print pages successively printed on the paper web 12. In the following, a length of 12 inches is assumed for one print page. A first print page S1 was generated in a first printing process and transfer-printed onto the paper web 12. Subsequently, the paper web 12, as already described in connection with FIG. 2, was pulled backward, after the first printing process had been terminated and the printing had been stopped.

Subsequently, in a new second printing process, the print page S2 had been generated and the toner image had been transfer-printed onto the paper web 12. Due to the change in the load angle, described in connection with FIGS. 3 and 4, an overlapping of the print images of the page S1 and S2 results. The end of the print image of the page S1 is illustrated by a broken line in FIG. 5. The continuous setting operation of the load angle already described in connection with FIGS. 3 and 4 causes a relatively small overlapping of about 0.1 mm. The usual drive speed of the belts of the paper web 12 is about 1 m/s in the present embodiment.

Figure 6:
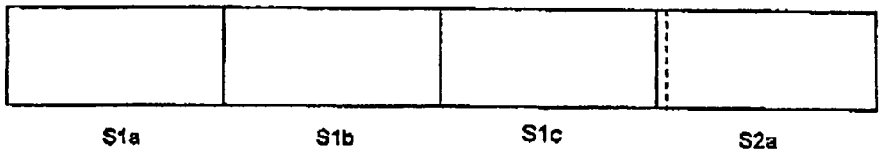
FIG. 6 is a pictorial illustration of four print pages successively printed on the paper web according to the prior art, with an interruption of the printing process after three pages.

In contrast to FIG. 5, in FIG. 6 three successive pages S1*a*, S1*b* and S1*c* were printed in the first printing process and after an interruption of the paper transport as well as after the swiveling-away and the swiveling-onto of the transfer belts, the page S2*a* was printed in a second printing process. The continuous change in the load angle already described results in a positional displacement of about 0.3 mm as an overlapping of the page S1*c* and S2*a* in the case of three print pages printed in the new second printing process, this overlapping being again illustrated by a broken line.

Figure 7:
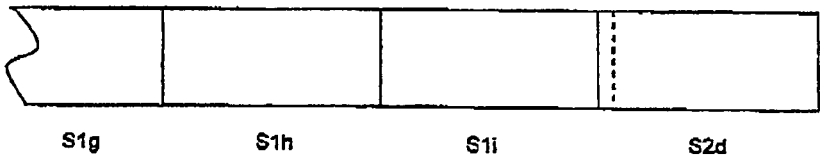
FIG. 7 is a pictorial illustration of several print pages, a positioning error which occurs after five or more print pages have been printed with known methods and arrangements being illustrated.

In contrast to the sequences according to FIGS. 5 and 6, according to FIG. 7 five or more print pages (the last three S1*g*, S1*h*, S1*i* shown) were generated in the first printing process and subsequently, at least one print page S2*d* was generated in the second printing process. After a transport length of five pages, a load angle of about $\alpha 1$ exists, which angle does not change further in the case of further printed pages. Therefore, for a printed length of five or more pages in the first printing process, an overlapping with the first page printed in the second printing process of about 0.9 mm results, this overlapping again being illustrated by a broken line.

Figure 8:
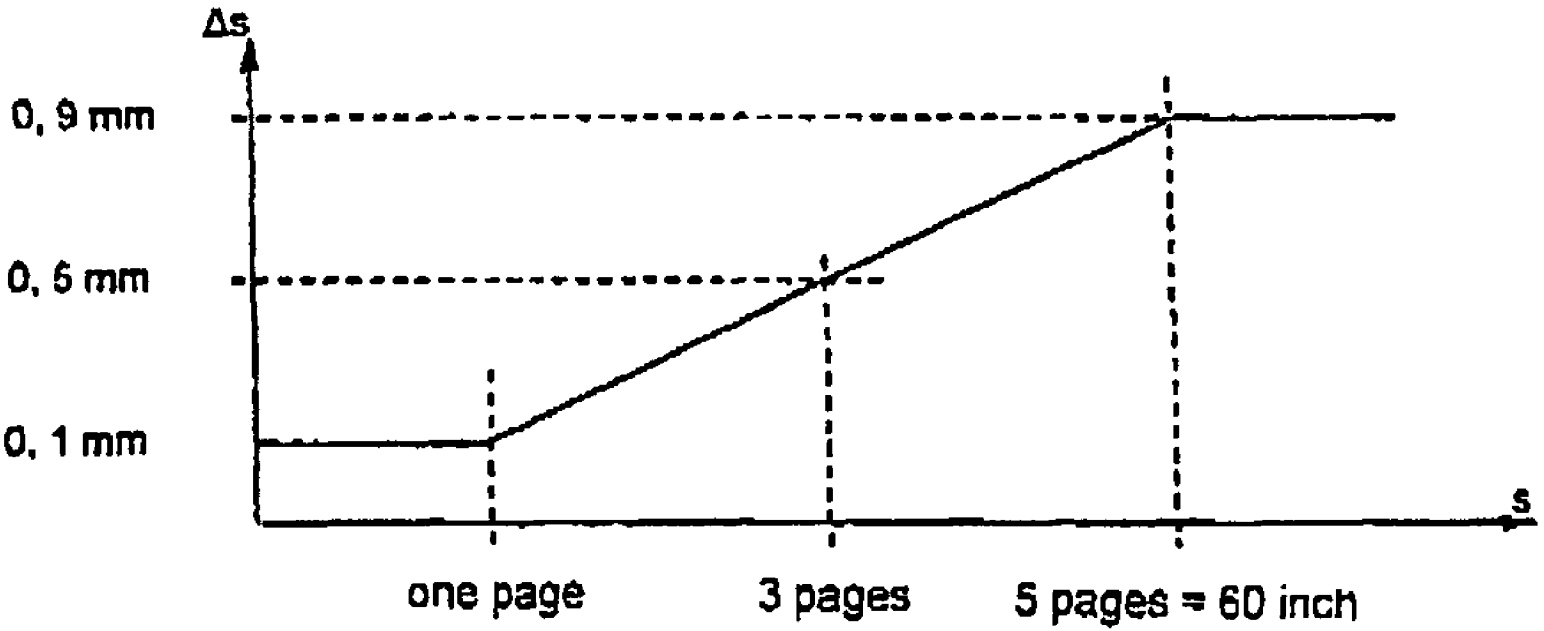
FIG. 8 is a distance-time diagram illustrating the positioning error as a function of the length of the previously printed paper web.

In FIG. 8, a diagram is illustrated, in which the amount of overlapping $\Delta s$ of print pages printed successively in different printing processes is illustrated as a function of the length of the paper web 12 that has been printed in the first printing process. With the aid of the diagram, the change in position of the print image generated in the second printing process which has been caused by the continuous change in the load angle a of the drive motor of the drive roller 42 is graphically represented.

The length of the paper web 12 printed in the first printing process is plotted on the abscissa and the misalignment between the last print image printed in the first printing process and the first print image printed in the second printing process is plotted on the ordinate. Thus, the misalignment amounts to about 0.1 mm for a printed length of $\leqq 12$ inches in the first printing process, to about 0.5 mm for 36 inches, and to about 0.9 mm in the case of 60 inches and more. These values of misalignment are positioning errors of the second print image, since this one overlaps the first print image, and had been determined empirically with the electrophotographic printing system 10 illustrated in FIG. 1.

For reducing the positioning error, the pulling force of the drive roller 50 can be increased, in order to reduce the change in the load angle occurring when the transfer belt 78 is swiveled onto and swiveled away from the paper web, as a result of which, due to an increased pulling force of the drive roller 50, the influence of the pulling force of the transfer belt 78 on the position of the paper web 12, i.e., on the positioning error of the paper web 12, is reduced. However, in the case of a pulling force that is too high, the probability of paper transport errors, in particular due to a tearing or a breaking of the paper web 12 (especially in the case of paper webs 12 having transverse folds) is increased so that the pulling force of the drive roller 50 cannot be chosen arbitrarily high.

On the basis of the determined positional misalignment of the individual print images S2, S2*a* and S2*b*, and with the transport speed of the paper web being known, one can determine the time interval by which a desired position of the paper web 12 has arrived at the transfer printing point 84 too early, i.e., by which the paper web 12 leads. For a transport speed of 1 m/s, in the case of a printed length of up to 12 inch, there results a time interval of 0.1 ms, in the case of a printed length of 36 inch a time interval of 0.5 m/s and in the case of a printed length of 60 inch or more, a time interval of 0.9 ms.

For a compensation, i.e., a correction of the positioning error, the time interval is determined in accordance with the previously printed length of the paper web 12 and, at the time t2, the start of the transport of the paper web 12 is delayed by the time interval that has been determined. Alternatively or additionally, in the time interval T3, the acceleration of the paper web 12 to transport speed v1 can be increased and/or the transport speed v1 in the time interval T3 of the paper web 12 can be increased. Further, after the termination of a printing operation, during the time interval T6, the positioning error to be expected afterwards can already be corrected particularly by extending the transport time T6 or by increasing the transport speed v2, since the paper web 12 is additionally pulled backward by the amount of the positioning error.

With the aid of the marginal perforations in the paper web 12 and/or with the aid of the synchronization marks on the paper web 12, the positional deviation of the actual position of the marginal perforations or synchronization marks is determined during a printing process and is controlled to the desired position with the aid of a paper position control. In doing so, the drive motor of the paper web drive serves as a control element. In the case of print images having a print image length of less than five print pages with a page length of 12 inches each, the paper position control, however, cannot or not completely correct the positional deviation occurring during the backward pulling of the paper web 12 as a result of the change in the load angle during the backward pulling. During the subsequent backward pulling of the paper web 12 there again results a positional displacement as a result of the change in the load angle. The positional deviation occurring during the backward pulling is substantially identical for every backward pulling.

In the case of a print image length of less than one print page, the positional deviation present because of the preceding backward pulling cannot be corrected yet so that, as a result of the subsequent change in the load angle during the transport of the paper web for transfer printing a toner image, there occurs a relatively small positional deviation of about 0.1 mm in the longitudinal direction of the paper web, and, as already described, an undesired overlapping of the front edge of a newly generated print image and the rear edge of a print image generated in a preceding printing process.

In contrast to this, in the case of a length of five or more print pages printed in the preceding printing process, there results an almost complete correction of the positional deviation. Therefore, via the subsequent change in the load angle during the transport of the paper web 12 for transfer printing of a toner image in the direction of the arrow P1, there results a relatively high positional deviation of about 0.9 mm in the longitudinal direction of the paper web 12.

In the case of print lengths in the preceding printing process of less than five pages, the non-corrected positioning error and the positional displacement as a result of the transport of the paper web 12 in the printing direction P1 cancel each other out at least in part. The positional deviation in the case of printing lengths between one and five print pages is substantially linear to the print image length or to the number of print pages.

Figure 9:
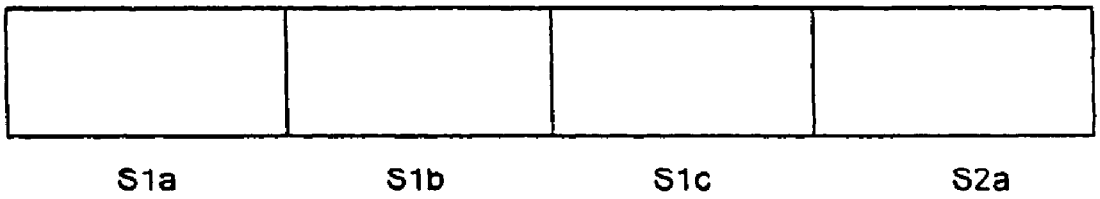
FIG. 9 is a pictorial illustration showing the positioning of the print images of successive print pages with a compensation of the positioning error according to various embodiments of the present invention.

FIG. 9 illustrates the arrangement of the pages S1*a*, S1*b*, S1*c*, S2*a* which have been generated on the paper web 12 in substantially the same manner as the print pages illustrated in FIG. 6, the start time of the transport of the carrier material being delayed by 0.5 ms.

As an alternative to a variation of the before-mentioned start time, the start time t7 or the stopping time t8 during the backward pulling of the paper web can be varied and, as a result, the time interval T6 can be shortened in order to displace the position of the print image at the transfer printing point in the next printing process and to thus compensate the positional error.

In known high-performance printers, even in the case of printer types having the same structure, there are different geometric ratios due to assembly tolerances, which ratios have an influence on the pulling forces acting on the paper web 12, on the drive of the paper web 12 as well as on the load angle $\alpha$ of the drive motors. Further, the positional error depends on the paper parameters of the paper web 12. Thus, the positional deviation curve resulting from the diagram illustrated in FIG. 8, as already described, has to be determined in a basic setting of the printer for this specific type of printer by using a standard paper or alternatively by using various types of paper. For this purpose, the overlapping values during the start of a new printing process are determined dependent on the printed length of the paper web 12 printed in the preceding printing process. From these overlapping values, the compensation curve which serves as a basis for the correction of the positional error is determined.

In the present embodiment, the compensation curve is determined for printing lengths in the range between 12 inches and 60 inches, which have been generated in the first printing process. It is assumed that for the type of printer illustrated in FIG. 1, no changes in the positioning error occur for less than 12 inches and for more than 60 inches. In addition to the basic setting determined when using standard paper for the printer, compensation curves are separately determined with regard to special papers, which curves can be assigned to the printer via a control unit of the printer in the case of a printing operation using special paper or are selected automatically after setting the type of paper.

Alternatively, the positioning error can be determined dynamically during the printing operation with the aid of the marginal perforation sensor 49 and/or the mark sensors 46, 48 and then be evaluated. In this process, a closed-loop control is used for the compensation which in the case of deviations of the position of the marginal perforations or the synchronization marks from a desired position is used as a control deviation.

After the start of the printing operation and after the transfer belt 78 has been swiveled away, the paper web 12 is still conveyed at a controlled desired speed during the time interval T5. During this time interval, the compensation of the load angle takes place, as a result of which, on the basis of the abrupt deviation of the actual position of the marginal perforations or synchronization marks from the desired position, the change in the load angle can be determined.

Figure 10:
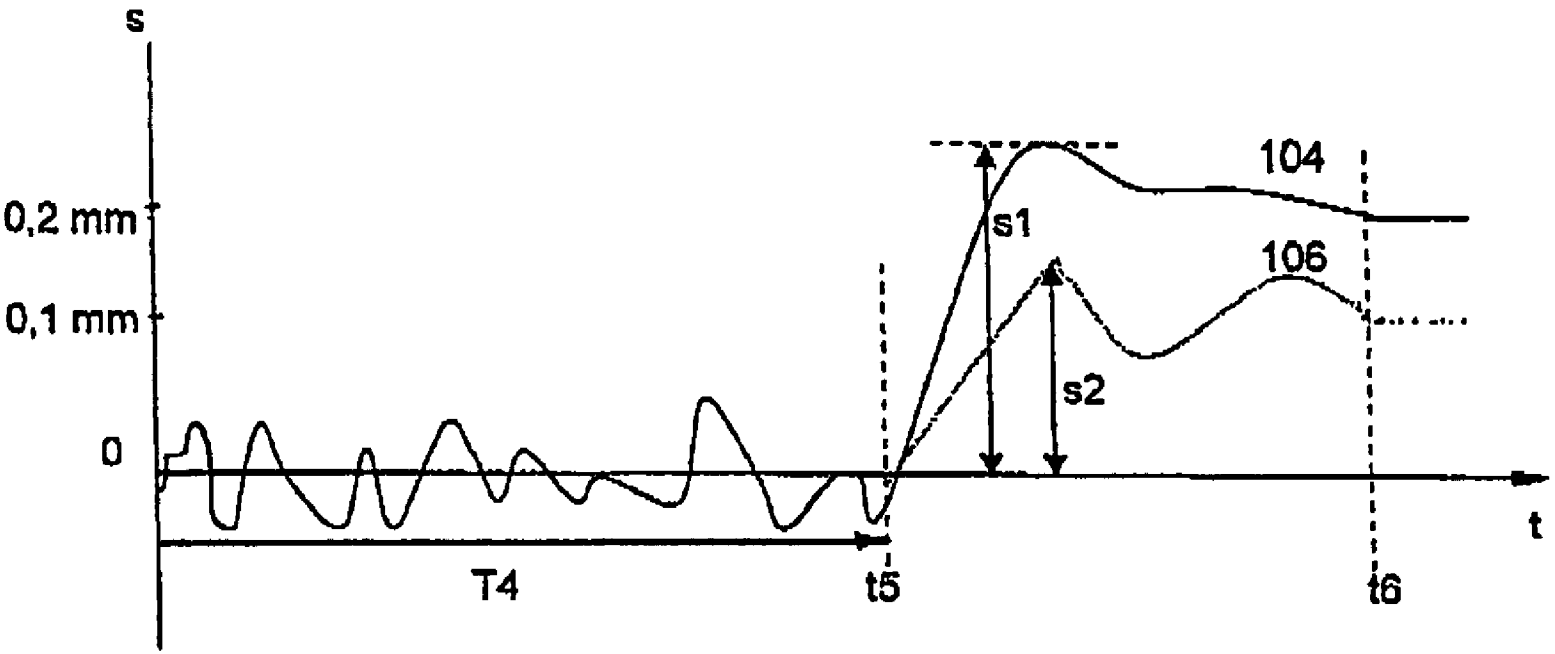
FIG. 10 is a distance-time diagram illustrating the positional deviation of the paper web from a desired position before and after the stopping of the printing process.

FIG. 10 is a timing diagram illustrating the deviation as plotted on a time axis t of the actual position of the paper web 12 from a desired position, i.e., the positioning error of the paper web 12 as a function of time before and after the transfer belt 78 has been swiveled away. The sequences substantially correspond to the sequences illustrated in FIG.

2. Up to the time t5, the transfer belt 78 is swiveled onto the paper web 12. The deviation of the position from the desired position of the paper web 12 varies in a tolerance range around the value 0. At the time t5, as already described in connection with FIG. 2, the transfer belt 78 is swiveled away from the paper web 12 so that as a result of the change in the load angle of the drive motor of the drive roller 42, a positioning error occurs. The change in the load angle causes a deviation by the amount s of the actual position of the paper web 12 from its desired position after the transfer belt 78 has been swiveled away.

In FIG. 10, a graph 104 illustrates the change in position of the paper web 12 after the previous printing of two print pages. The amount of the maximum positional deviation is referenced by s1 for the graph 104 in FIG. 10. Further, a graph 106 is illustrated in FIG. 10 with the aid of a dotted line, the curve of this graph 106 being substantially identical to the one of the graph 104 up to the time t5.

The graph 106 illustrates the deviation of the actual position from the desired position of the paper web 12 after the preceding printing of a print page, i.e., of 12 inches of the paper web 12. The maximum positional deviation of the desired position from the actual position in the preceding printing of one page is referenced by s2 in FIG. 10. At the time t6, the standstill of the paper web 12 has been reached so that from this time t6, the positional deviation is constant since the paper web 12 stands still with this positional deviation.

During the subsequent start of the transport of the paper web 12, the positional deviation substantially still exists. This existing positioning error can be corrected via the already described measures of changing the start time, changing the backward pulling distance, and changing the speed of the transfer belt. Preferably, the positional deviation determined is likewise communicated to the perforation sensor for monitoring the positional marks of the paper web 12 in order to adapt the desired time of the arrival of the positional marks at the sensor in accordance with the positional displacement.

Figure 11:
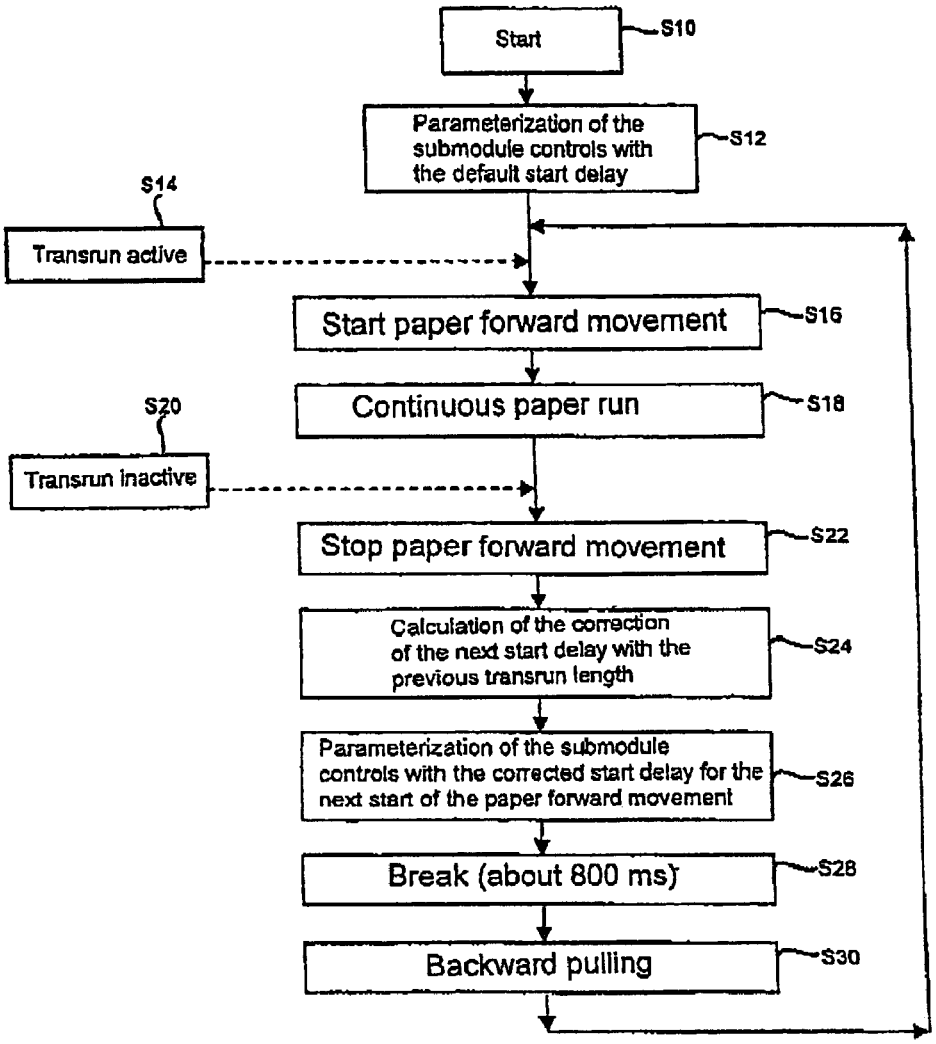
FIG. 11 is a flowchart illustrating the sequence during the start and the stop of the printing process with a correction of the positioning error in the printer or copier.

In FIG. 11 a flowchart of a printing process according to FIG. 2 is illustrated, in which the correction of the positioning error is carried out with the aid of a start delay of the transport of the paper web 12. In step S10, the sequence is started. In step S12, a basic setting of the start delay T1 is transferred to the control units 22, 26 as well as to submodule controls, particularly for the interpretation of the perforation sensor, and stored in a storage area of the respective control or the respective module.

Subsequently, in step S14 a start signal "TRANSRUN" of the printing process is generated which starts the generation of a print image at the time t1. Based on this signal "TRANSRUN", all subsequent control operations of the printing process are controlled. Subsequently, in step S18, after the start of the paper forward movement at the time t2 in step S16, a continuous paper travel of the paper web 12 is achieved. After, in step S20, the generation of the print image in the printing process has been terminated and no further print data is processed, the transport of the paper web 12 is stopped after the time interval T2 in step S22.

Subsequently, in step S24, the positional deviation is determined based on the length of the generated print image, and a value for the correction of the start delay is calculated. Subsequently, the controls and modules parameterized in step S12 with an initial value of the start delay T1 are parameterized with a corrected value of the start delay T1 for the next start of the paper forward movement by transferring the new start delay values to this control and the submodules.

After the standstill of the paper web 12 in step S22 and the calculation of the new start delay values in the steps S24 and S26, a break of about 800 ms during which no transport of the paper web 12 takes place is generated in step S28. Subsequently, in step S30, a backward pulling of the paper web 12 takes place, as already described in connection with FIG. 2. Subsequently, the sequence is continued in that, in step S14, it waits for a starting signal for a further printing process. Thus, after every completed printing process, the start delay time T1 for starting the forward movement of the paper web 12 in the following printing process, which start delay time is required for the correction of the position, is determined.

Figure 12:
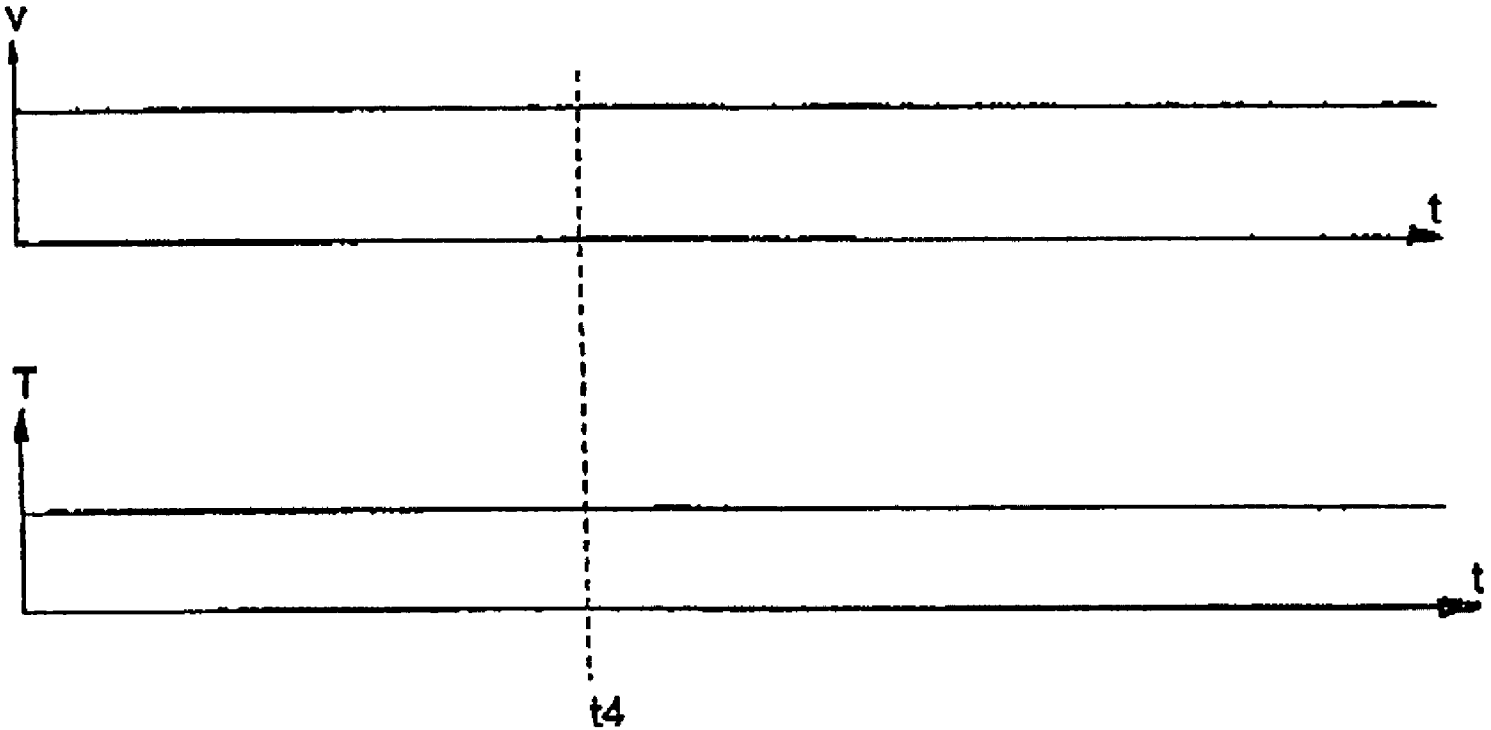
FIG. 12 is a speed-time diagram and a circulation time-time diagram representing an ideal behavior when the transfer belt is swiveled onto the paper web, with no positioning error occurring.

FIG. 12 illustrates a speed-time diagram plotted on a time axis t and a circulation time-time diagram, illustrating the speed or the circulation time of the transfer belt 78 before and after the transfer belt is swiveled onto the paper web 12 at the time t4 for an ideal swiveling-onto without any positioning error. The speed of the transfer belt before the transfer belt 78 is swiveled onto the paper web 12 is identical to the speed of the transfer belt 78 after this swiveling-onto, and the circulation time of the transfer belt 78 before this swiveling is ideally identical to the circulation time of the transfer belt 78 after the transfer belt has been swiveled onto the paper web. The swiveling of the transfer belt 78 onto the paper web 12 is also referred to as "contacting". Typically, the speed of the transfer belt is predetermined by a pre-set circulation time T of the transfer belt 78. Alternatively or additionally, the circulation time T is determined. The circulation time T of the transfer belt 78 can be determined easily with relatively simple cost-efficient sensors, such as a light barrier or an optical sensor.

Figure 13:
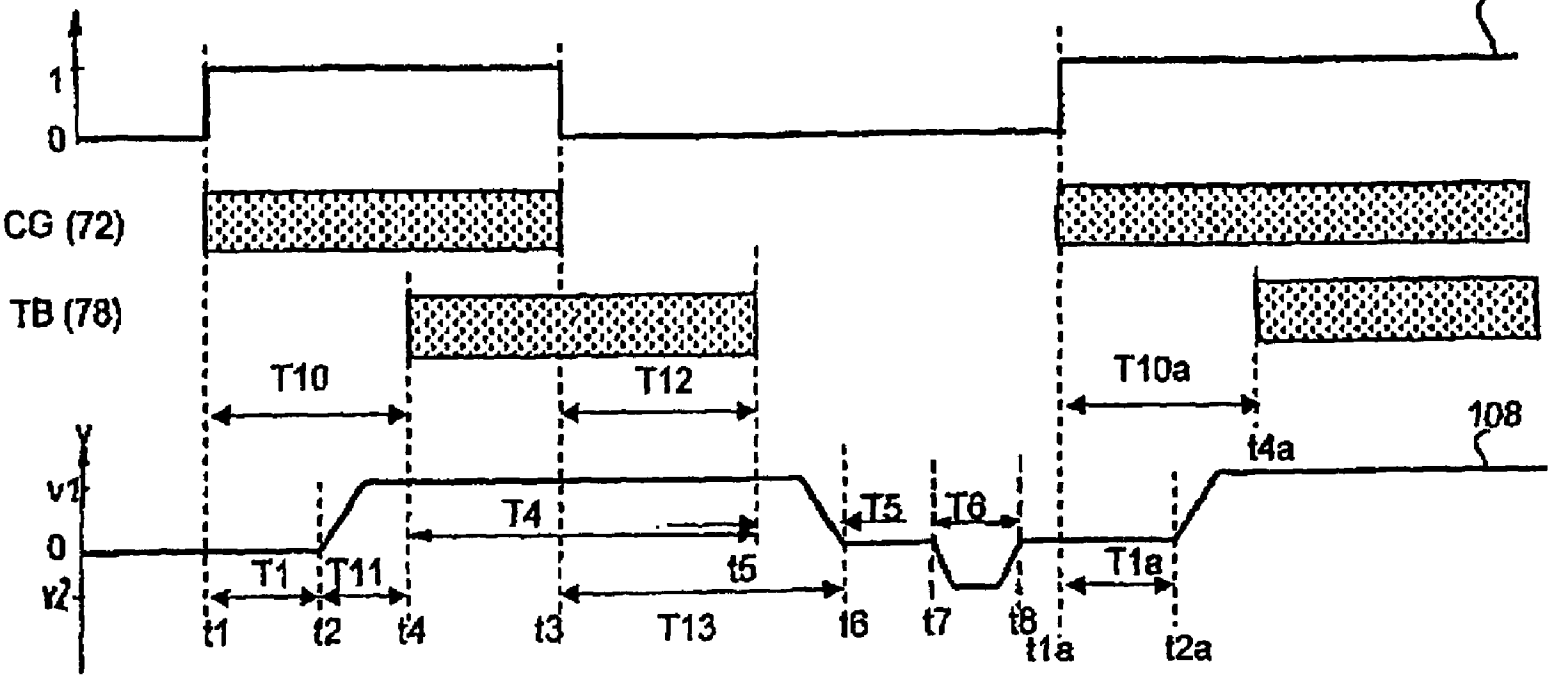
FIG. 13 is a timing diagram illustrating the transport speed of the paper web as a function of the control of an image generating unit.

FIG. 13 is a diagram similar to the diagram according to FIG. 2, illustrating the sequence of the generation of print images in two successive printing processes. A first graph 108 of the diagram according to FIG. 13 indicates a signal for the starting and the stopping of the generation of charge images by the character generator on the photoconductor belt 68. This signal is also referred to as the "TRANSRUN" signal. The generation of charge images with the aid of the character generator 72 is illustrated again in the character representation below the graph 108. Due to the running time of the print image from the character generator 72 to the transfer printing point 84 for transfer printing the toner image from the transfer belt 78 onto the paper web 12, a time interval T10 is required in the case of a constant drive speed of the photoconductor and of the transfer belt 78. The time interval T10 is the interval between the time t1, at which the character generator 72 starts writing the charge image on the photoconductor belt 68, up to the arrival at the front edge of the toner image generated from this charge image at the transfer printing point 84 at the time t4.

Starting out from the time t1, a time interval T1 is allowed to pass by until the transport of the paper web 12 is started at the time t2. At the time t2, the transport of the paper web 12 is started by accelerating the paper web 12 to transport speed v1 and by further conveying the same at this speed. At the time t4, the transfer belt 78 is swiveled onto the paper web 12, and the transfer of the toner image from the transfer belt 78 onto the paper web 12 is started and lasts up to the time t5 at which the complete toner image has been transferred from the transfer belt 78 onto the paper web 12, and the transfer belt 78 is again swiveled away from the paper web 12. Starting out from the time t3, at which the generation of the charge image by the character generator has been terminated and the "TRANSRUN" signal again has the state 0, the toner image is still transferred from the transfer belt 78 onto the paper web 12 for the time T12, i.e., up to the time t5, the time interval T12 substantially corresponding to the time interval T10. Thus, starting out from the time t3, there results a time interval T13 up to the time t6 at which the paper web 12 stands still. Between the swiveling away of the transfer belt 78 at the time t5 and the standstill of the paper web 12, a time interval T5 results. As previously mentioned, the time interval T10 approximately corresponds to the time interval T12, the time interval T10 being the sum of time interval T1 and the time interval T11, and the time interval T12 resulting from the subtraction of the time interval T5 from the time interval T13.

As already described in connection with FIG. 2, the paper web 12 is subsequently conveyed in the opposite direction in order to obtain an initial position for a subsequent printing process. At the time t1*a*, which is an arbitrary time after the backward transport of the paper web 12, a second printing process is started in which, at the time t1*a*, the character generator 72 generates a further charge image on the photoconductor belt 68. After a time interval T1*a*, the transport of the paper web 12 is started at the time t2*a*. After the time interval T10*a* starting out from the time t1*a*, the transfer belt 78 is swiveled onto the paper web 12 and the transfer of the toner image from the transfer belt 78 onto the paper web 12 is started at the time t4*a*. The termination of the second printing process substantially takes place in the same manner as the termination of the first printing process.

Figure 14A:
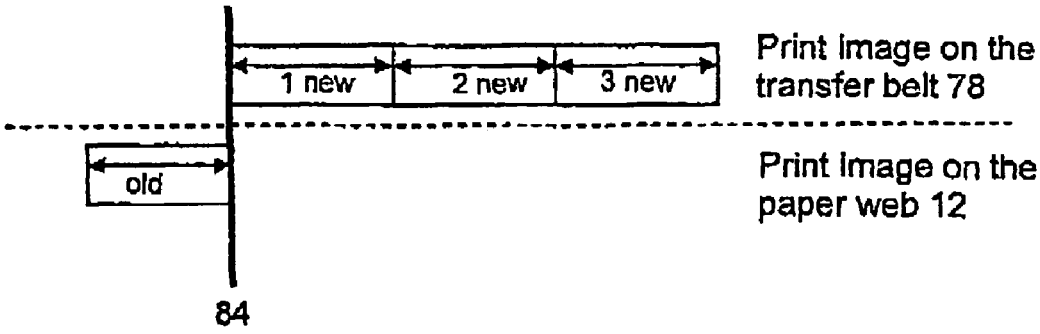
FIG. 14*a* is a state diagram illustrating the positioning of a toner image transfer-printed onto the paper web at the transfer printing point in a preceding first printing process as well as three toner images present on the transfer belt at the time when the transfer belt is swiveled onto the paper web.

FIG. 14*a* is a diagram illustrating the generated print images on the paper web 12 and on the transfer belt 78 at the transfer printing point 84. In FIG. 14*a*, the arrangement of the print pages at the time t4 is illustrated. In the present embodiment, the effective circulation length between the transfer printing point 80 (the transfer printing from the photoconductor belt 68 onto the transfer belt 78) and the transfer printing point 84 (the transfer printing from the transfer belt 78 onto the paper web 12) amounts to 36 inches and thus corresponds to a length of three print pages. At the time t4, thus three pages to be printed are present on the photoconductor belt 68 and the transfer belt 78, at least one page already printed in a preceding printing process being present on the paper web 12.

The transport speed v1 of the paper web 12 is synchronized with the writing speed of the character generator 72, i.e., in the same unit of time in which a print page of a character generator is generated, subsequently inked with toner and transferred onto the transfer belt 78, it is transferred at the transfer printing point 84 from the transfer belt 78 onto the paper web 12, and thus, independent of the belt speeds of the photoconductor belt 68 and of the transfer belt 78, it has the length on the paper web 12 that has been determined by the character generator 72.

As already described, the belt speeds of the photoconductor belt 68 and of the transfer belt 78 are slightly higher than the transport speed of the paper web 12. As a result, the print image is extended in the transport direction of the photoconductor belt 68 at the character generator 72 and is again compressed to the correct length at the transfer printing point 84 between the transfer belt 78 and the paper web 12. Thus, as illustrated in FIG. 14*a*, there results that the print page printed on the paper web 12 is shorter than the print pages present on the photoconductor belt 68 and the transfer belt 78.

Figure 14B:
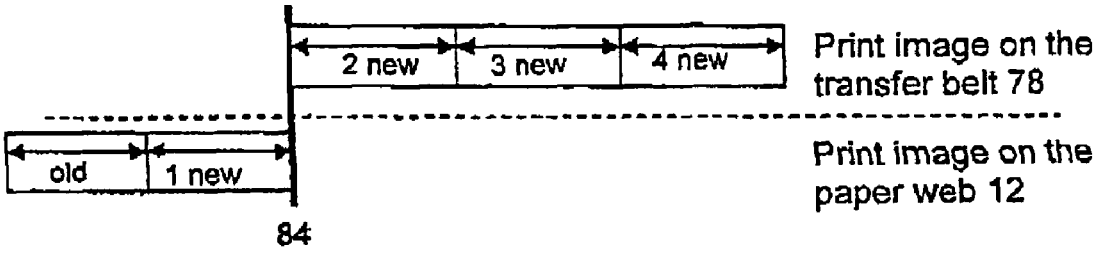
FIG. 14*b* is the state diagram according to FIG. 14*a*, a print page of a new second printing process already having been transfer-printed onto the paper web and the toner image of a further print page also being generated by the image generating unit.

As in FIG. 14*a*, FIG. 14*b* illustrates the arrangement of print pages with respect to the transfer printing point 84, with, in contrast to FIG. 14*a*, the first page generated in the second printing process already being transfer-printed onto the paper web 12. The broken line in FIG. 14*b*, like the broken line in FIG. 14*a*, indicates the spatial distance of the print images at the transfer printing point 84, the print images provided below the broken line being arranged on the paper web 12 and the print images provided above the broken line being arranged on the transfer belt 78 and/or the photoconductor belt 68.

The first page "1 new" generated in the second printing process which in FIG. 14*b*, in contrast to FIG. 14*a*, has already been transfer-printed onto the paper web 12, is shortened compared to the state illustrated in FIG. 14*a*, in which the print page "1 new" is still provided on the transfer belt 78. This shortening of the print image is caused by the previously mentioned compression at the transfer printing point 84 as a result of the different speeds of the paper web 12 and of the transfer belt 78. Such a page to be printed is also referred to as a "form" and the page length as a "form length".

Thus, in the present embodiment the drive speed of the photoconductor belt 68 and/or of the transfer belt 78 is higher than the transport speed of the paper web 12. Nevertheless, the writing time of one page at the character generator 72, i.e., the duration of the generation of the charge image, and the transfer printing period of the same page at the transfer printing point 84, are identical at least from page "4 new" on. Thus, the case of constant belt speeds results in the recording time of the charge image for one print page being identical to the transfer printing time of this print page from the photoconductor belt 68 onto the transfer belt 78 and identical to the transfer printing period at the transfer printing point 84 from the transfer belt 78 onto the paper web 12.

The length of the page on the photoconductor belt 68 or on the transfer belt 78 is, as already described, longer than the length of the same page on the paper web 12. In FIGS. 14*a* and 14*b*, the print pages printed in the first printing process have been referenced by "old" and the print pages generated in the second printing process have been referenced by a consecutive number and "new".

FIG. 15 is a speed-time diagram and a circulation time-time diagram, both plotted on a time axis t, illustrating, in contrast to the diagram illustrated in FIG. 12, the actual change in the belt speed Δv of the transfer belt 78 or in the actual circulation time of the transfer belt 78 caused in that the transfer belt 78 is swiveled onto the paper web 12 at the time t4. For simplification, the change in speed or the change in circulation time is illustrated as a digital change, with, during the swiveling onto of the transfer belt 78, the circulation speed v being reduced from a fast speed Vtfb fast by 0.22 μm/ms after this swiveling-onto. The circulation time T of the transfer belt 78 is increased by 0.4 ms in this embodiment.

Figure 16:
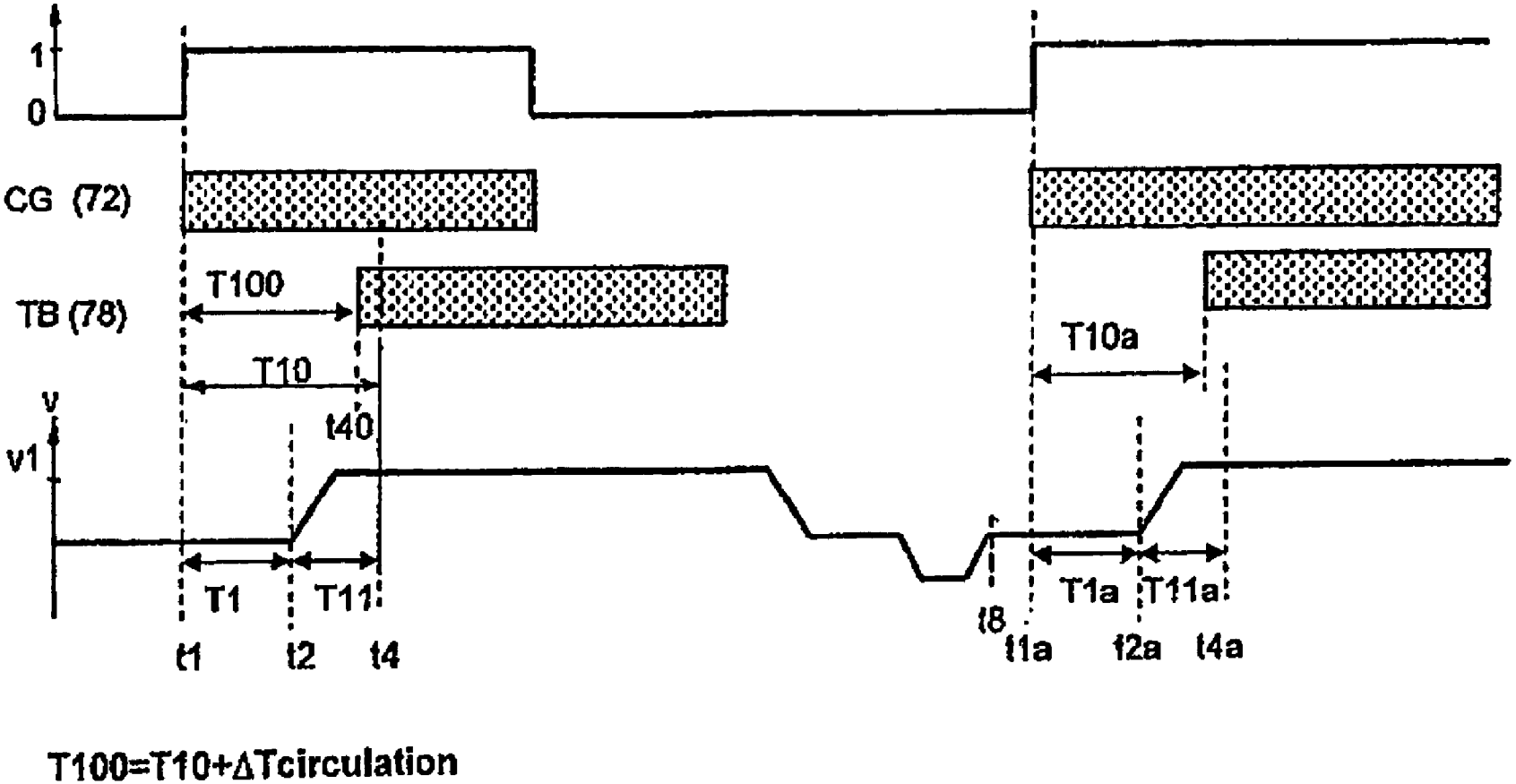
FIG. 16 is a speed-time diagram illustrating the transport speed of the paper web as a function of the position of generated print images.

FIG. 16 is a speed-time diagram illustrating the transport speed v of the paper web 12 as a function of the image generating signal TRANSRUN. At the time t1, as already described in connection with FIGS. 2 and 13, the generation of a charge image on the photoconductor belt 68 with the aid of the character generator 72 is started. At this time, the photoconductor belt 68 and the transfer belt 78 are driven at the increased speed according to FIG. 15, i.e., at a speed increased by 0.22 μm/ms.

At the time t4, as already described in connection with FIGS. 2 and 13, and which occurs at a time T100 after starting the generation of the change image on the photoconductor belt, the transfer belt 78 is swiveled onto the paper web 12 in order to transfer a toner image present on the transfer belt 78 onto the paper web 12. However, at this time, due to the increased speed of the photoconductor belt 68 and of the transfer belt 78, a part of the toner image has been guided past the transfer printing point 84 so that this can no longer be transferred onto the paper web 12. Thus, the transfer belt 78 would already have to be swiveled onto the paper web 12 at the time t40 in order to completely transfer the generated toner image onto the paper web 12.

However, the paper web 12 arrives at the position at the transfer printing point at which the transfer of the toner image from the transfer belt 78 onto the paper web 12 is to take place at the time t4. Thus, the transfer of the toner image already has to be started at the time t40, at this time the transfer belt 78 having to be swiveled onto the paper web 12. After the termination of the first printing process at the time t8, a second printing process is subsequently started at the time t1*a*, during which substantially the same displacement of the print image on the transfer belt 78 with respect to the paper web 12 occurs.

When the transfer of the toner image from the transfer belt 78 onto the paper web 12 is already started at the time t40, then, further, a positioning error of the print image on the paper web 12 occurs. The start of the transport of the paper web 12 is delayed by the difference between the times t4 and t40 in order to correct the positioning error of the paper web 12 during the advance of the time of transfer printing. As noted above with respect to FIG. 13, at the time t1*a*, which is an arbitrary time after the backward transport of the paper web 12, a second printing process is started in which, at the time t1*a*, the character generator 72 generates a further charge image on the photoconductor belt 68. After a time interval T1*a*, the transport of the paper web 12 is started at the time t2*a*. After the time interval T1O*a* starting out from the time t1*a*, the transfer belt 78 is swiveled onto the paper web 12 and the transfer of the toner image from the transfer belt 78 onto the paper web 12 is started at the time t4*a*. The time T11*a* reflects the amount of time between the start of the paper web 12 transport at time t2*a* and the start of the transfer of toner image from the transfer belt 78 onto the paper web at the time t4*a*.

Figure 17A:
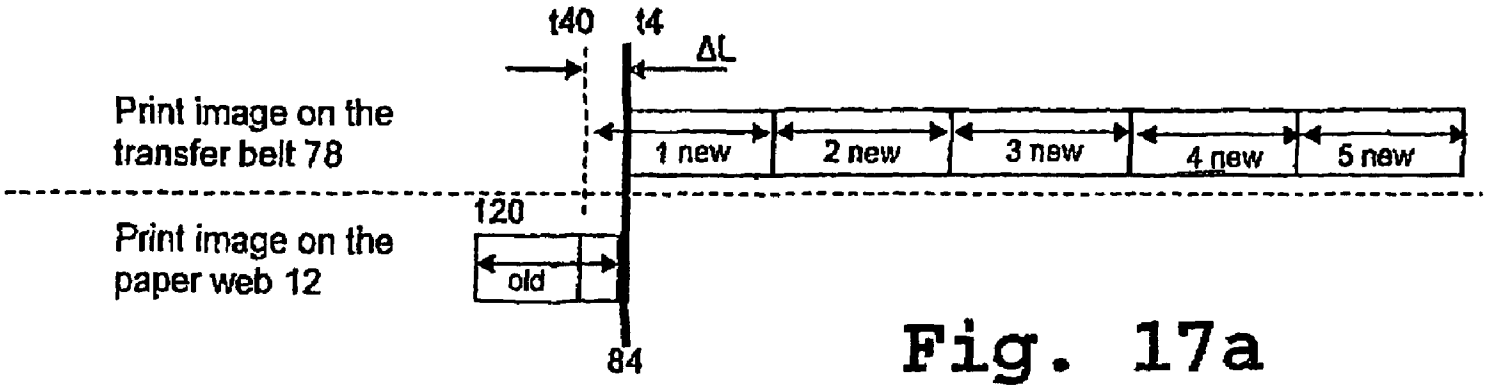
FIG. 17*a* is a state diagram illustrating a positioning error of print images on the paper web when the printing on the paper web is continued after a print interruption as well as different page lengths resulting therefrom according to the prior art.

FIG. 17*a* illustrates the overlapping of the print images of the first printing process and of the second printing process at the transfer printing point 84. The transfer belt 78 was swiveled onto the paper web 12 at the time t40 according to FIG. 16. As a result, at this time t40, the transfer printing of the front edge of the toner image present on the transfer belt 78 is started. However, at the time t40, the print image "old" printed in the preceding printing process during time 120 has not been completely conveyed past the transfer printing point 84. The preceding print image "old" is only completely conveyed past the transfer printing point 84 at the time t4. At this time t4, thus the transfer printing of the first page "1 new" of the new printing process would have to be started, so that this one joins flush with the page "old". When the transfer belt 78 is swiveled onto the paper web at the time t40, an overlapping of the page "old" with the area 120 of the page 1 "new" occurs.

The length of the overlapping area of the two print images in FIG. 17*a* is referenced by ΔL. This overlapping results from the increased belt speed of the transfer belt 78 when the transfer belt 78 is swiveled away. In the present embodiment, an increased slip is present between the photoconductor belt 68 and the transfer belt 78 after the transfer belt 78 has been swiveled onto the paper web 12. Due to the increased belt speed of the transfer belt 78 and, with the same writing speed of the character generator 72, the print image of the pages "1 new", "2 new" and "3 new" is generated such that it is extended in the longitudinal direction P1. In other words, the print images of the pages "1 new" to "3 new" are not compressed at the transfer printing point 80 in the manner as the following print pages "4 new", "5 new" and "6 new".

As already explained, the effective transport length between the character generator 72 and the transfer printing point 84 amounts to about 36 inches, i.e., three page lengths. Between the character generator 72 and the transfer printing point 84, the effective transport length amounts to approximately 60 inches, i.e., about five print page lengths. Thus, the print images generated with the aid of the character generator 72 up to the swiveling-onto of the transfer belt 78 and transferred onto the transfer belt 78 are extended in the longitudinal direction, as a result of which the print pages "1 new", "2 new" and "3 new" are longer than the following print pages "4 new" and "5 new". As a result, the page "1 new" overlaps the page "old" by the amount ΔL. Further, the pages "1 new", "2 new" and "3 new" have a greater length than the pages "4 new" and all following pages.

Figure 17B:
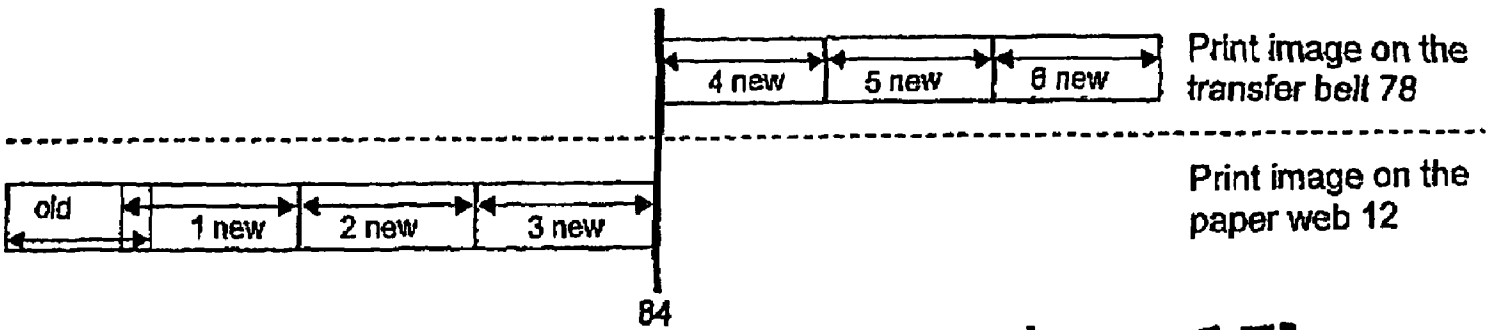
FIG. 17*b* is the state diagram according to FIG. 17*a*, already three pages having been transfer-printed, which pages have been generated in the new, second printing process.

FIG. 17*b* illustrates the arrangement according to FIG. 17*a*, the positioning of the print pages illustrated in FIG. 17*a* being illustrated at a later point in time after the transfer printing of the page "3 new". As previously described in connection with FIG. 17*a*, the page "1 new" overlaps the page "old" by the amount ΔL. Further, the pages "1 new", "2 new" and "3 new" have a greater length on the paper web 12 than the pages "old" and the print pages "4 new", "5 new" and "6 new" which are still to be transfer-printed onto the paper web 12 as well as the print pages subsequently generated in the second printing process.

Figure 18:
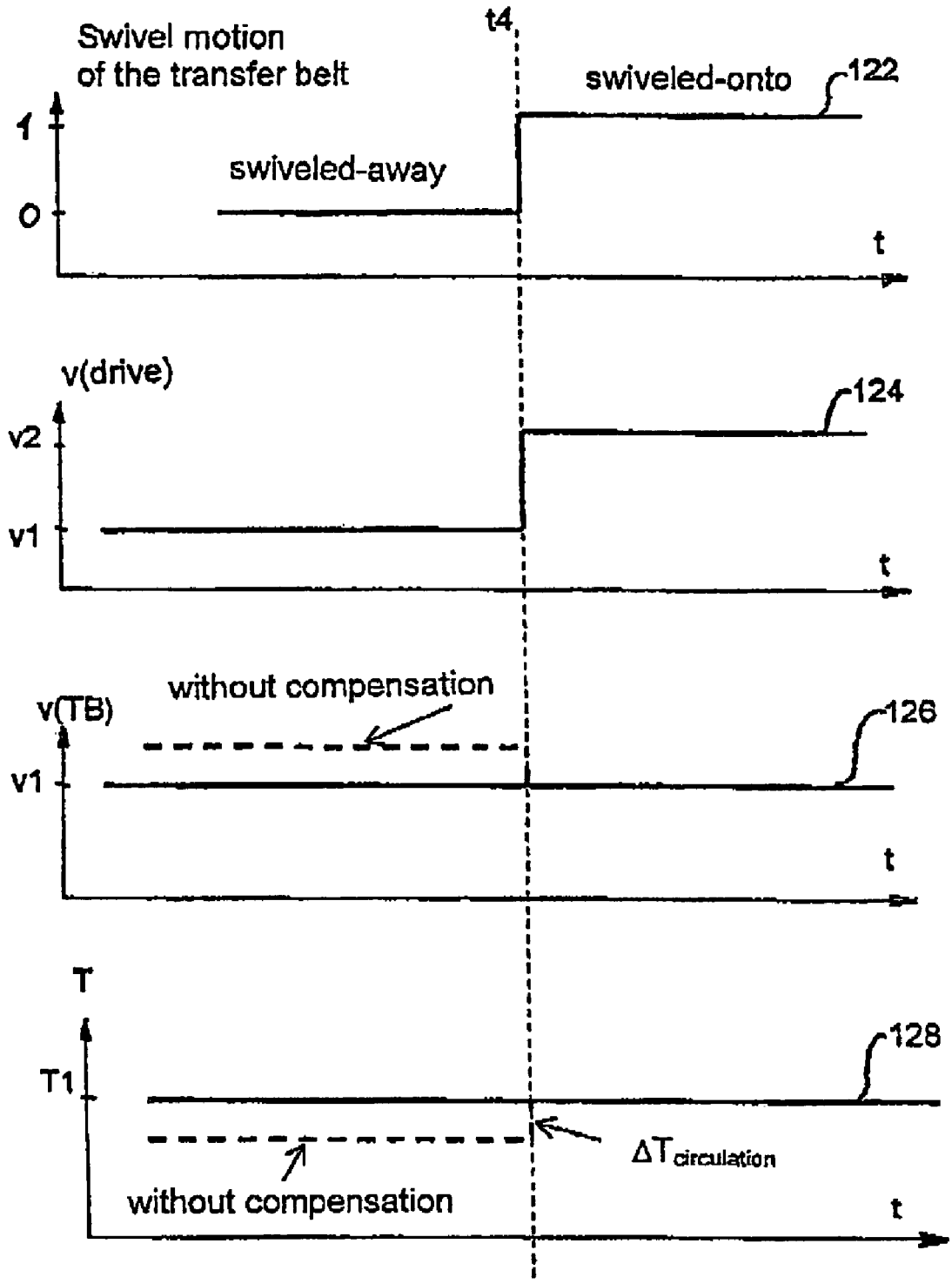
FIG. 18 is a timing diagram arrangement illustrating the increase or initial decrease of the drive speed of the transfer belt when the transfer belt is swiveled onto the paper web, used for the correction of a positioning error, this diagram arrangement illustrating the state of the transfer belt, the circulation time and the effective speed of the transfer belt.

FIG. 18 illustrates diagrams in which the changes in speed and in circulation time of the transfer belt 78 before and after the time t4 are illustrated, a first compensation possibility for the compensation of the positioning error which leads to the overlapping of the print images by the amount ΔL being indicated. A first graph 122 shows the change in state of the contacting of the transfer belt 78 with the paper web 12 at the time t4, the transfer belt 78 being swiveled away from the paper web 12 before the time t4 and being swiveled onto the paper web 12 after the time t4, and thus contacts the paper web 12 after being swiveled to it.

For a correction of the positioning error, at least the transfer belt 78 is driven at a first reduced transport speed v1 up to the time t4 and after this time at an increased transport speed. This is illustrated by the graph 124 in FIG. 18. The graph 126 indicates the effective speed v1 of the transfer belt 78. Before the time t4, only an insignificant slip occurs at the drive roller of the transfer belt 78 so that the speed v1 of the transfer belt 78 is substantially identical to the drive speed v1 of the graph 124.

With the aid of the broken line, the speed curve of the transfer belt 78 without a change in the drive speed of the transfer belt 78 according to the graph 124 is illustrated. Since the transfer belt 78 is swiveled onto the paper web 12 at the time t4, the transfer belt 78 is decelerated and there occurs an increased slip at the drive roller of the transfer belt 78. As a result, the speed of the transfer belt 78 is reduced.

By the simultaneous increase of the drive speed of the transfer belt 78 at the time t4, this reduction in speed is compensated for so that the transfer belt 78 is driven at a constant speed v1 before and after the time t4 in the next graph 126. As a result of the constant effective speed v1 of the transfer belt 78, the circulation time T1 of the transfer belt 78 before and after the transfer belt 78 has been swiveled onto the paper web 12 is the same.

As in the case of the effective speed v1 of the transfer belt 78, as illustrated by the graph 128, in the case of the circulation time T1 of the transfer belt 78 the change in circulation time given a constant drive speed of the transfer belt 78 is illustrated with the aid of a broken line, which circulation time is increased as a result of the increased slip at the drive roller at the time t4, this increased slip resulting after the transfer belt has been swiveled onto the paper web. Preferably, the drive speed of the photoconductor belt 68 is adapted in the same way as the drive speed of the transfer belt 78.

For simplification, the changes in state during the swiveling of the transfer belt 78 onto and away from the paper web 12 are illustrated as digital changes in state in FIG. 18 as well as in the further Figures described. This type of illustration serves as a simplification of both the problem definition and the problem solution. In the actual changes in state, however, transient processes and gradual changes of state occur. The transient processes start at least in part before the time t4 of the digital change in state and possibly end at a time after the digital change in state.

Figure 19:
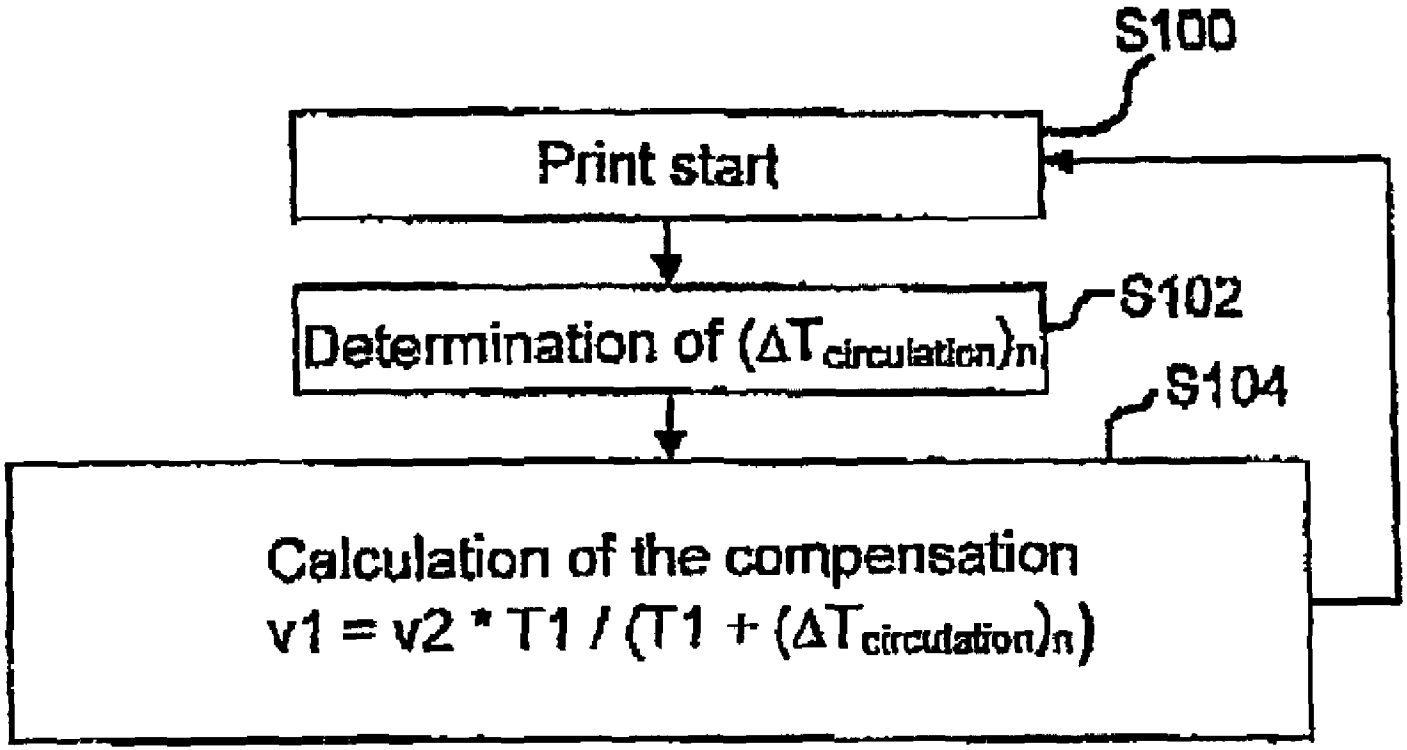
FIG. 19 is a simplified flowchart for determining a reduced initial speed as a function of the change in circulation speed when the transfer belt is swiveled onto the paper web, this change having been determined in the preceding printing process.

FIG. 19 is a schematic flowchart for the correction of the positioning error of the print image, which error has been explained with the aid of FIG. 15. In step S100, a first printing process is started. Subsequently, in step S102, the circulation time T of the transfer belt 78 is determined before and after the time t4, i.e., before and after the transfer belt 78 is swiveled onto the paper web 12.

Subsequently, in step S104, the reduced drive speed of the transfer belt 78 is determined, which, according to the graph 124 of FIG. 18, serves as a drive speed for the transfer belt 78 up to the time t4 when the transfer belt 78 is swiveled onto the paper web 12. The reduced drive speed of the transfer belt 78 is calculated by multiplying the drive speed of the transfer belt 78 after the transfer belt 78 has been swiveled onto the paper web 12 by the belt circulation time T and subsequently dividing by the sum of belt circulation time T and the determined change in circulation time ΔT.

Preferably, the sequence illustrated in FIG. 19 is run at the start of each printing process, the correction value determined in the preceding printing process being used for a position correction, and in addition, the change in the circulation time of the transfer belt 78 when the transfer belt 78 is swiveled onto the paper web 12 being determined. With the aid of the newly determined value of the change in the circulation time ΔT, the speed value v1 already corrected by the previously determined change in circulation time is adapted again in the repeatedly performed step S104. Preferably, the value of the change in circulation time is determined in a signed manner so that an increase in the circulation speed v1 or in the circulation time of the transfer belt 78 as a result of swiveling the transfer belt 78 onto the paper web is likewise determined and corrected.

Figure 20:
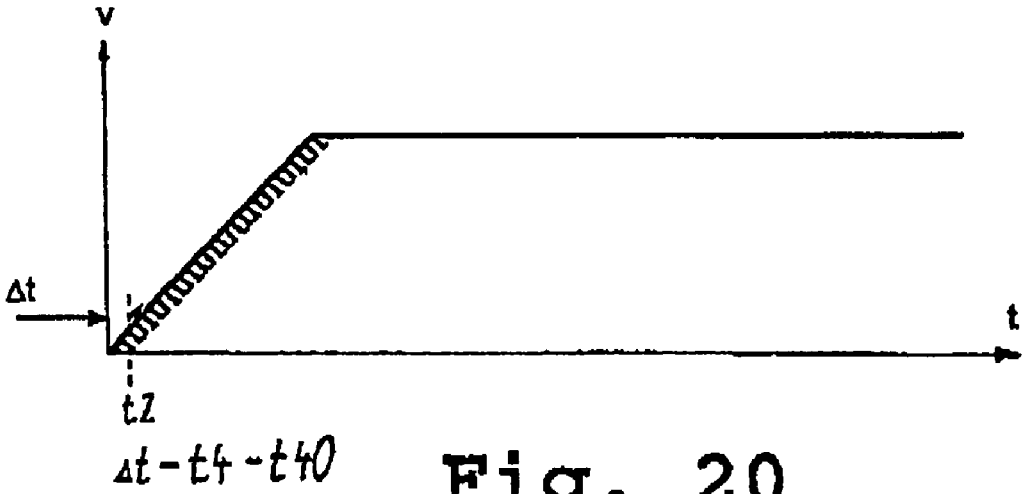
FIG. 20 is a speed-time diagram illustrating the speed curve of the paper web for avoiding a positioning error, in which the start time of the paper transport has been changed for correction.

In FIG. 20, a speed-time diagram is illustrated in which alternatively or additionally to the solution possibility described in connection with FIG. 18, the start time of the transport of the paper web 12 is advanced by the interval determined with the aid of the determined change in circulation time so that the paper web 12 has already been conveyed so far when the transfer belt 78 is swiveled onto the paper web 12 at the time t40 that the front edge of the print image "1 new" is transfer-printed at the rear edge of the print image of the page "old".

As a result, the pages "old" and "1 new" will lie flush, i.e., with register accuracy, on the paper web 12. The speed curve illustrated with the aid of the solid line in FIG. 20 is the speed curve including the advance of the start time of the transport of the paper web 12, and the speed curve illustrated with the aid of the broken line is the speed curve without an advancement of the start time. The transport of the paper web 12 thus starts without an advancement of the start time at the time t2 and with an advancement at the time t2 minus Δt, where Δt=t4−t40.

Figure 21:
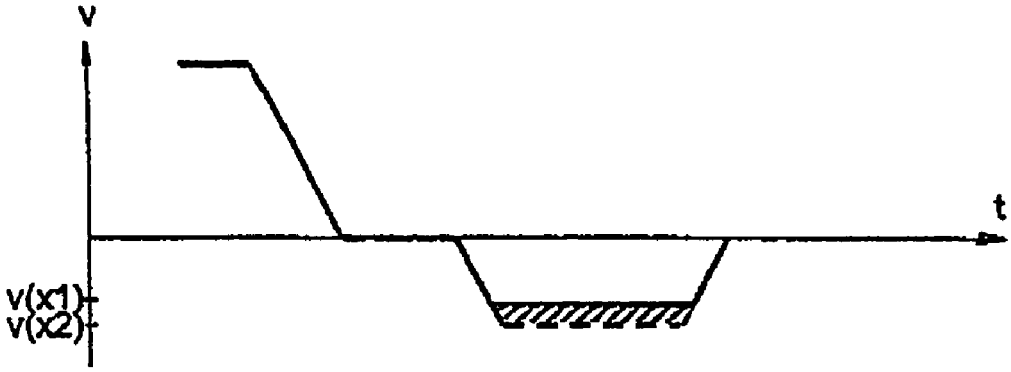
FIG. 21 is a speed-time diagram illustrating the correction of a positioning error during the backward transport of the paper web via a varied backward pulling speed.

FIG. 21 is a speed-time diagram illustrating the transport speed of the paper web 12 particularly during the backward pulling of the paper web 12 after the termination of a printing process. After the termination of the printing process, the transport speed of the paper web 12 is reduced with the aid of a negative ramp acceleration to 0. After a preset transport interruption, the paper web 12 is accelerated in the direction opposite to the normal transport direction, the backward pulling speed only being accelerated up to the value v(×1) for position correction.

The paper web 12 is conveyed at the speed v(×1) for a preset time, and subsequently, the speed is reduced to the value 0 in a defined manner so that the paper web 12 stands still and a further printing process can be started. The normal backward pulling speed is v(×2) so that by way of the reduction of the backward pulling speed, the positioning error explained in FIGS. 17*a* and 17*b* can be corrected by reducing the backward pulling speed, alternatively or additionally to the solutions indicated in FIGS. 18 and 20.

In the solutions described in FIGS. 20 and 21, the charge images are generated with the aid of the character generator 72 on the photoconductor belt 68 in a compressed manner in order to adapt the length of the print images after transfer printing to the page lengths of the pages "old" and "4 new", "5 new" and further print pages. Alternatively to the reduction of the transport speed during the backward pulling of the paper web 12, illustrated in FIG. 21, the backward pulling time interval T6 of the paper web 12 can be reduced as well.

In the embodiments, the change in drive speed is only described in connection with the printing unit 16. However, both printing units 16, 18 are substantially identically controlled. The circulation times of the transfer belts 78 are then determined separately for each transfer belt and, with the aid of the circulation times determined, a separate correction value is then determined for each transfer belt 78 or for each transfer belt drive. The described correction possibilities of a positional deviation or positioning error of the paper web 12 with respect to the print image to be generated or to be transfer-printed, can, however, likewise be used in printing systems having only one printing unit in the same way as for the printing system having two printing units and illustrated in FIG. 1.

In the case of printing systems having three or more printing units, the described methods and devices for the position correction can readily be used as well. In the case of a printing mechanism 14 having only one printing unit, a roller is provided as a pressure roller at the transfer printing point 84 on the side of the paper web 12 opposite to the transfer belt 78.

In other embodiments, a photoconductor drum is used instead of the photoconductor belt 68 and/or a transfer roller is used instead of the transfer belt 78, their drives being controlled in the same manner as the drives of the photoconductor belt 68 and of the transfer belt 78. Further, instead of the LED character generator, a laser character generator can be used.

While preferred embodiments have been illustrated and described in detail in the drawings and foregoing description, the same is to be considered as illustrative and not restrictive in character, it being understood that only the preferred embodiments have been shown and described and that all changes and modifications that come within the spirit of the invention both now or in the future are desired to be protected. Reference has been made to the preferred embodiments illustrated in the drawings, and specific language has been used to describe these embodiments. However, no limitation of the scope of the invention is intended by this specific language, and the invention should be construed to encompass all embodiments that would normally occur to one of ordinary skill in the art.

The present invention may be described in terms of functional block components and various processing steps. Such functional blocks may be realized by any number of hardware and/or software components configured to perform the specified functions. For example, the present invention may employ various integrated circuit components, e.g., memory elements, processing elements, logic elements, look-up tables, and the like, which may carry out a variety of functions under the control of one or more microprocessors or other control devices. Similarly, where the elements of the present invention are implemented using software programming or software elements the invention may be implemented with any programming or scripting language such as C, C++, Java, assembler, or the like, with the various algorithms being implemented with any combination of data structures, objects, processes, routines or other programming elements. Furthermore, the present invention could employ any number of conventional techniques for electronics configuration, signal processing and/or control, data processing and the like.

The particular implementations shown and described herein are illustrative examples of the invention and are not intended to otherwise limit the scope of the invention in any way. For the sake of brevity, conventional electronics, control systems, software development and other functional aspects of the systems (and components of the individual operating components of the systems) may not be described in detail. Furthermore, the connecting lines, or connectors shown in the various figures presented are intended to represent exemplary functional relationships and/or physical or logical couplings between the various elements. It should be noted that many alternative or additional functional relationships, physical connections or logical connections may be present in a practical device. Moreover, no item or component is essential to the practice of the invention unless the element is specifically described as "essential" or "critical". Numerous modifications and adaptations will be readily apparent to those skilled in this art without departing from the spirit and scope of the present invention.

LIST OF REFERENCE CHARACTERS

10 electrophotographic printing system
12 continuous paper web
14 printing mechanism
16, 18 printing units
20 paper feed
22 control unit
24 toner storage and preparation unit
26 image processing unit
28 paper web guiding and monitoring system
30 fixing station
32 to 40 deflection rollers
42, 50 drive roller
44, 52 pressure roller
46, 48 mark sensor
49 perforation sensor
54, 56 fixing unit
58, 60 covering device
62, 64 cooling elements
66 belt drive
68 photoconductor belt
70 cleaning and charging unit
72 character generator
74 developer station
76 belt drive
78 transfer belt
80, 84 transfer printing area, roll drive
86 drive roll
100 to 128 graphs
S10 to S106 method steps

What is claimed is:

1. A method for generating positionally accurate print images on a carrier material with the aid of an electrophotographic printer or copier, comprising:

contacting a carrier material to be printed with a toner image carrier, a positioning error occurring;

determining the positioning error of a position of the carrier material with respect to a toner image present on the toner image carrier dependent on a length of a first toner image that was printed on the carrier material in a previous print step; and adapting, dependent on the positioning error determined, for every subsequent contacting of the carrier material to be printed with the toner image carrier, the position of the carrier material with respect to the toner image before contacting such that the carrier material and the toner image are arranged with respect to one another substantially free of positioning errors.

2. The method according to claim 1, further comprising:

empirically determining the positioning error for a particular printer or copier; and providing the positioning error determined for a preset as a parameter.

3. The method according to claim 1, wherein the positioning error is determined during a set-up of the printer.

4. The method according to claim 1, wherein the toner image carrier is at least one of a photoconductor belt, a photoconductor drum, a transfer roller and a transfer belt.

5. The method according to claim 1, wherein the positioning error is caused by the contacting of the carrier material by the toner image carrier.

6. The method according to claim 5, wherein a circulation speed of the toner image carrier at least slightly deviates from a transport speed of the carrier material.

7. The method according to claim 6, wherein the circulation speed of the toner image carrier is higher than the transport speed of the carrier material.

8. The method according to claim 1, wherein the carrier material has a low flexural strength and is a continuous paper web.

9. A method for generating positionally accurate print images on a carrier material with the aid of an electrophotographic printer or copier, comprising:

generating at least a first toner image on a toner image carrier;

transfer-printing the first toner image from the toner image carrier onto a carrier material, the carrier material being contacted by the toner image carrier during the transfer printing at at least one transfer printing point;

performing a relative movement, after the transfer printing of the first toner image, between the carrier material and the toner image carrier such that the carrier material is no longer contacted by the toner image carrier;

generating at least a second toner image on the toner image carrier;

positioning the carrier material, for the transfer printing of the second toner image, with respect to the position of the second toner image generated on the toner image carrier such that the second toner image is transfer-printed at a predetermined distance to the first toner image; and correcting, depending on a printer-specifically or copier-specifically determined positioning error of a position of the carrier material with respect to a toner image present on the toner image carrier dependent on a length of a first toner image that was printed on the carrier material during the step of transfer-printing the first toner image occurring during the positioning of the carrier material, at least one of a position of the carrier material and a position of the toner image carrier.

10. The method according to claim 9, wherein the predetermined distance is zero so that the second toner image joins flush with the first toner image.

11. The method according to claim 9, wherein the carrier material is a continuous carrier material, the method further comprising:

determining the length of the first toner image aided by the number and the lengths of the print pages included in the first toner image.

12. The method according to claim 9, further comprising:

conveying the carrier material in a first direction past the transfer printing point during transfer printing;

conveying the carrier material a preset distance in a second direction substantially opposite to the first direction after the toner image carrier has been swiveled away from the carrier material or after the carrier material has been swiveled away from the toner image carrier;

accelerating the carrier material in the first direction to transfer printing speed before the transfer printing of the second toner image, a start time of repeated transport in the first direction being determined dependent on a start time of the generation of the second toner image on the toner image carrier.

13. The method according to claim 12, further comprising:

advancing or delaying the start time dependent on the positioning error.

14. The method according to claim 12, further comprising:

varying the preset distance of the carrier material to be traveled dependent on the positioning error.

15. The method according to claim 12, further comprising:

varying at least one of the acceleration of the carrier material to transport speed and the transport speed of the carrier material depending on the positioning error.

16. The method according to claim 12, further comprising:

varying a transport speed of the toner image carrier depending on the positioning error.

17. An arrangement for generating positionally accurate print images on a carrier material aided by an electrophotographic printer or copier, comprising:

carrier material to be printed; and a toner image carrier that contacts the carrier material, wherein a positioning error occurs, wherein, dependent on the determined positioning error of a position of the carrier material with respect to a toner image present on the toner image carrier dependent on a length of a first toner image that was printed on the carrier material in a previous print step occurring during the contacting of the carrier material to be printed with the toner image carrier, for every contacting of the carrier material to be printed with the toner image carrier, the carrier material and the toner image carrier are positioned with respect to one another before the contacting such that after the contacting, the carrier material is positioned with respect to the toner image substantially free of positioning errors.

18. An arrangement for generating positionally accurate print images on a carrier material aided by an electrophotographic printer or copier, comprising:

a toner image carrier on which at least a first toner image and at least a second toner image can be generated;

a device configured for performing a relative movement between the toner image carrier and a carrier material;

a control unit configured for controlling the relative movement such that the toner image carrier contacts the carrier material during transfer printing of each toner image from the toner image carrier onto the carrier material at at least one transfer printing point, and in that the carrier material no longer contacts the toner image carrier after the transfer printing of the first toner image;

a drive unit configured for conveying the carrier material, which, for transfer printing the second toner image onto the carrier material, positions the carrier material such that the second toner image is transfer-printed onto the carrier material at a preset distance to the first toner image;

the arrangement being configured to, dependent on a printer-specific or copier-specific positioning error of a position of the carrier material with respect to a toner image present on the toner image carrier dependent on a length of a first toner image that was printed on the carrier material in a previous print step occurring during the positioning of the carrier material, perform a correction of at least one of the position of the carrier material and the position of the toner image carrier.

19. A method for generating positionally accurate print images on a carrier material aided by an electrophotographic printer or copier, comprising:

generating at least one toner image on a toner image carrier, at least one portion of the toner image being generated during a first operating state, in which a surface of the toner image carrier does not contact a carrier material to be printed;

driving the toner image carrier at a first circulation speed during the first operating state;

driving the carrier material at a transport speed during transfer printing of the toner image from the toner image carrier onto the carrier material, the transport speed being at least slightly slower than the first circulation speed;

moving the toner image carrier and the carrier material relative to one another such that the surface of the toner image carrier contacts the carrier material to be printed for the transfer printing of the toner image during a second operating state;

reducing the first circulation speed of the toner image carrier to a second circulation speed after contacting; and determining and correcting a positioning error caused by the change in circulation speed during the transfer printing of the toner image at a transfer printing point.

20. The method according to claim 19, further comprising:

determining printer-specific or copier-specific positioning error in a transport direction of the carrier material.

21. The method according to claim 19, further comprising:

determining the positioning error for at least one of various carrier materials and various contact pressures between the toner image carrier and the carrier material at the transfer printing point.

22. The method according to claim 19, further comprising:

setting the second operating state when a front edge of the toner image generated on the toner image carrier arrives at the transfer printing point.

23. The method according to claim 19, further comprising:

determining a reduction factor aided by a difference between the first and the second circulation speed; and generating the toner image or images during the first operating state on the toner image carrier such that they are reduced in size in the transport direction of the carrier material by the reduction factor.

24. The method according to claim 19, further comprising:

determining a start time of transporting the carrier material aided by the second circulation speed depending on the start time of the generation of the toner image on the toner image carrier.

25. The method according to claim 24, further comprising:

varying the start time determined depending on the positioning error.

26. The method according to claim 25, further comprising:

varying the position of the carrier material along the transport direction depending on the positioning error before the start of the transport of the carrier material.

27. The method according to claim 24, further comprising:

varying the transport speed of the carrier material depending on the positioning error.

28. The method according to claim 24, further comprising:

reducing, during the first operating state, the first circulation speed to approximately the second circulation speed depending on the positioning error.

29. The method according to claim 19, further comprising:

generating a first toner image on a first toner image carrier;

generating a second toner image on a second toner image carrier;

transfer-printing the first toner image onto a front side of the carrier material at the transfer printing point;

transfer-printing the second toner image onto a rear side of the carrier material at the transfer printing point; and determining a first positioning error occurring during the transfer printing of the first toner image and a second positioning error occurring during the transfer printing of the second toner image.

30. The method according to claim 29, further comprising:

determining an average value of the first and of the second positioning error as a positioning error to be corrected.

31. The method according to claim 19, further comprising:

empirically determining the positioning error of the printer or copier; and utilizing the empirically determined positioning error as a parameter pre-set.

32. The method according to claim 19, further comprising:

utilizing a control to switch into the first operating state after termination of the second operating state, the carrier material being conveyed in a first direction past the transfer printing point during transfer printing, and, after repeatedly reaching the first operating state, the carrier material being conveyed a preset distance in a second direction that is substantially opposite to the first direction, in that the carrier material is accelerated in the first direction up to transfer printing speed before the transfer printing of the second toner image, the start time of the repeated transport in the first direction being determined dependent on a start time of a generation of the second toner image on the toner image carrier.

33. The method according to claim 32, further comprising:

varying the preset distance to be traveled depending on the positioning error.

34. The method according to claim 19, further comprising:

determining the positioning error during a set-up of the printer.

35. The method according to claim 19, wherein the toner image carrier is a photoconductor belt, a photoconductor drum, or a transfer belt.

36. The method according to claim 19, wherein the carrier material has a low flexural strength, and is particularly a continuous paper web.

37. The method according to claim 19, wherein the second circulation speed is higher than the transport speed approximately by a value in the range between 0.5% to 1%, and in that the first circulation speed is higher than the second circulation speed approximately by a value in the range between 0.05% to 0.4%.

38. An arrangement for generating positionally accurate print images on a carrier material aided by an electrophotographic printer or copier, comprising:

a toner image carrier on which at least one toner image can be generated, at least a portion of the toner image being generatable in a first operating state, in which the surface of the toner image carrier does not contact a carrier material to be printed;

a first drive unit configured to drive the toner image carrier at a first circulation speed during the first operating state;

a second drive unit configured to drive the carrier material at a transport speed during the transfer printing of the toner image from the toner image carrier onto the carrier material, the transport speed being at least slightly slower than the first circulation speed;

a device configured to perform a relative movement between the toner image carrier and the carrier material such that a surface of the toner image carrier contacts the carrier material to be printed for transfer printing the toner image in a second operating state, and after contacting, the first circulation speed of the toner image carrier being reduced to a second circulation speed, which approximately corresponds to the transport speed of the carrier material, a positioning error caused by the change in circulation speed during the transfer printing of the toner image at the transfer printing point being determinable and at least one of the first and second drive unit being controllable such that the carrier material is arranged with respect to the toner image carrier substantially free of positioning errors during transfer printing.

* * * * *